US007520796B2

(12) United States Patent
Muldowney

(10) Patent No.: US 7,520,796 B2
(45) **Date of Patent: *Apr. 21, 2009**

(54) POLISHING PAD WITH GROOVES TO REDUCE SLURRY CONSUMPTION

(75) Inventor: Gregory P. Muldowney, Earleville, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/005,241

(22) Filed: Dec. 26, 2007

(65) Prior Publication Data

US 2008/0182493 A1 Jul. 31, 2008

Related U.S. Application Data

(63) Continuation-in-part of application No. 11/700,490, filed on Jan. 31, 2007.

(51) Int. Cl.

| | |
|---|---|
| ***B24B 1/00*** | (2006.01) |
| ***B24B 7/10*** | (2006.01) |
| ***B24B 7/30*** | (2006.01) |
| ***B24B 5/00*** | (2006.01) |
| ***B24B 29/00*** | (2006.01) |
| *B24D 11/04* | (2006.01) |

(52) U.S. Cl. ..... 451/56; 451/41; 451/285

(58) Field of Classification Search ..... 451/285, 451/41, 527, 550

See application file for complete search history.

(56) References Cited

U.S. PATENT DOCUMENTS

| | | | | |
|---|---|---|---|---|
| 2,883,802 | A * | 4/1959 | Katzke | 451/56 |
| 5,081,051 | A * | 1/1992 | Mattingly et al. | 451/56 |
| 5,643,053 | A * | 7/1997 | Shendon | 451/28 |
| 5,664,987 | A * | 9/1997 | Renteln | 451/21 |
| 5,695,392 | A * | 12/1997 | Kim | 451/288 |
| 5,749,771 | A * | 5/1998 | Isobe | 451/41 |
| 5,860,853 | A * | 1/1999 | Hasegawa et al. | 451/285 |
| 6,386,962 | B1 * | 5/2002 | Gotkis et al. | 451/388 |
| 6,729,946 | B2 * | 5/2004 | Kimura | 451/388 |
| 6,869,335 | B2 * | 3/2005 | Taylor | 451/41 |
| 6,869,348 | B1 * | 3/2005 | Spiegel | 451/398 |
| 6,962,520 | B2 * | 11/2005 | Taylor | 451/41 |
| 7,001,248 | B1 * | 2/2006 | Chen et al. | 451/14 |
| 2001/0044268 | A1 * | 11/2001 | Shendon | 451/285 |

* cited by examiner

*Primary Examiner*—Joseph J Hail, III
*Assistant Examiner*—Alvin J Grant
(74) *Attorney, Agent, or Firm*—Blake T. Biederman

(57) ABSTRACT

A chemical mechanical polishing pad having an annular polishing track and a concentric center O. The polishing pad includes a polishing layer having a plurality of pad grooves formed therein. The polishing pad is designed for use with a carrier, e.g., a wafer carrier, that includes a polishing ring having a plurality of carrier grooves. Each of the plurality of pad grooves has a carrier-compatible groove shape configured to enhance the transport of a polishing medium beneath the carrier ring on the leading edge of the carrier ring during polishing.

10 Claims, 17 Drawing Sheets

POLISHING PAD WITH GROOVES TO REDUCE SLURRY CONSUMPTION

This application is a continuation-in-part of U.S. Ser. No. 11/700,490, filed Jan. 31, 2007, now pending.

BACKGROUND OF THE INVENTION

The present invention generally relates to the field of chemical mechanical polishing (CMP). In particular, the present invention is directed to a CMP pad having grooves that reduce slurry consumption.

In the fabrication of integrated circuits and other electronic devices on a semiconductor wafer, multiple layers of conducting, semiconducting and dielectric materials are deposited onto and etched from the wafer. Thin layers of these materials may be deposited by a number of deposition techniques. Common deposition techniques in modern wafer processing include physical vapor deposition (PVD) (also known as sputtering), chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the surface of the wafer becomes non-planar. Because subsequent semiconductor processing (e.g., photolithography) requires the wafer to have a flat surface, the wafer needs to be periodically planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize semiconductor wafers and other workpieces. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad has a diameter greater than twice the diameter of the wafer being planarized. During polishing, the polishing pad and wafer are rotated about their respective concentric centers while the wafer is engaged with the polishing layer. The rotational axis of the wafer is offset relative to the rotational axis of the polishing pad by a distance greater than the radius of the wafer such that the rotation of the pad sweeps out an annular "wafer track" on the polishing layer of the pad. When the only movement of the wafer is rotational, the width of the wafer track is equal to the diameter of the wafer. However, in some dual-axis polishers the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, is flowed onto the polishing pad and into the gap between the wafer and polishing layer. The wafer surface is polished and made planar by chemical and mechanical action of the polishing layer and polishing medium on the surface.

The interaction among polishing layers, polishing media and wafer surfaces during CMP is being increasingly studied in an effort to optimize polishing pad designs. Most of the polishing pad developments over the years have been empirical in nature. Much of the design of polishing surfaces, or layers, has focused on providing these layers with various patterns of voids and arrangements of grooves that are claimed to enhance slurry utilization and polishing uniformity. Over the years, quite a few different groove and void patterns and arrangements have been implemented. Prior art groove patterns include radial, concentric circular, Cartesian grid and spiral, among others. Prior art groove configurations include configurations wherein the width and depth of all the grooves are uniform among all grooves and configurations wherein the width or depth of the grooves varies from one groove to another.

These groove patterns and configurations, however, overlook the utilization of slurry related to CMP polishers having active wafer carrier rings. Unlike CMP polishing equipment of earlier generations, these carrier rings confront the polishing surface independently, and under significantly higher pressure, than the wafer being polished. These factors often create a squeegee effect at the leading edge of the wafer, wherein much of the film of liquid, e.g., slurry, on the pad texture is swept off by the carrier ring. The loss of this potentially usable slurry may reduce the effectiveness and predictability of the polishing process, while resulting in significant additional process costs. Presently, certain wafer carriers available from Applied Materials, Inc., Santa Clara, Calif., have carrier rings that include grooves that may reduce the squeegee effect by admitting additional slurry into the area under the wafer surface.

While polishing pads have a wide variety of groove patterns, the effectiveness of these groove patterns varies from one pattern to another, as well as from polishing process to polishing process. Polishing pad designers are continually seeking groove patterns that make the polishing pads more effective and useful relative to prior polishing pad designs.

STATEMENT OF THE INVENTION

In one aspect of the invention, a polishing pad for use in conjunction with a carrier ring having at least one carrier groove and a leading edge relative to the polishing pad when the polishing pad and carrier ring are being used for polishing at least one of a magnetic, optical and semiconductor substrate in the presence of a polishing medium, the at least one carrier groove having an orientation relative to the carrier ring, the polishing pad having a radius extending from a center of the polishing pad and the radius having a length, the polishing pad comprising: a polishing layer configured for polishing at least one of a magnetic, optical and semiconductor substrate in the presence of a polishing medium, the polishing layer including a circular polishing surface having an annular polishing track during polishing; and at least one pad groove having a carrier-compatible groove shape within the polishing track with at least a portion of the carrier-compatible groove shape being radial or curved radial and the carrier-compatible groove shape being tangent to a radius of the polishing pad in at least one location along the length of the radius, the carrier-compatible groove shape determined as a function of the orientation of the at least one carrier groove so that the at least one carrier groove aligns with the at least one pad groove at a plurality of locations along the carrier-compatible groove shape when the at least one carrier groove is on the leading edge of the carrier ring during polishing.

In another aspect of the invention, a polishing pad designed to cooperate with a carrier ring having at least one carrier groove and a leading edge relative to the polishing pad when the polishing pad and carrier ring are being used for polishing at least one of a magnetic, optical and semiconductor substrate in the presence of a polishing medium, the at least one carrier groove having an orientation relative to the carrier ring, the polishing pad having a radius extending from a center of the polishing pad and the radius having a length, the polishing pad comprising: a polishing layer configured for polishing at least one of a magnetic, optical and semiconductor substrate in the presence of a polishing medium, the polishing layer including a circular polishing surface having an annular polishing track during polishing; and at least one pad groove set having two or more pad grooves, the two or more pad grooves formed in the polishing layer and each of the two or more pad grooves having a carrier-compatible groove shape with at least a portion of the carrier-compatible groove shape being radial or curved radial and the carrier-compatible groove shape being tangent to a radius of the polishing pad in at least one location along the length of the radius and the carrier-compatible groove shape within the polishing track aligning with at least one carrier groove as a function of the orientation of the at least one carrier groove when the at least one carrier groove is located along the leading edge of the carrier ring during polishing.

In yet another aspect of the invention, a method of making a rotational polishing pad for use with a carrier ring having at least one carrier groove and a leading edge relative to the polishing pad when the polishing pad and carrier ring are being used for polishing at least one of a magnetic, optical and semiconductor substrate in the presence of a polishing medium, the at least one carrier groove having an orientation relative to the carrier ring, the polishing pad having a radius extending from a center of the polishing pad and the radius having a length, the method comprising: determining a carrier-compatible groove shape in substantial alignment with at least one carrier groove as a function of the orientation of the at least one carrier groove when the at least one carrier groove is located along the leading edge of the carrier ring during polishing; and forming in the rotational polishing pad at least one pad groove having the carrier-compatible groove shape with at least a portion of the carrier-compatible groove shape being radial or curved radial and the carrier-compatible groove shape is tangent to a radius of the polishing pad in at least one location along the length of the radius.

DETAILED DESCRIPTION OF THE INVENTION

Figure 1:
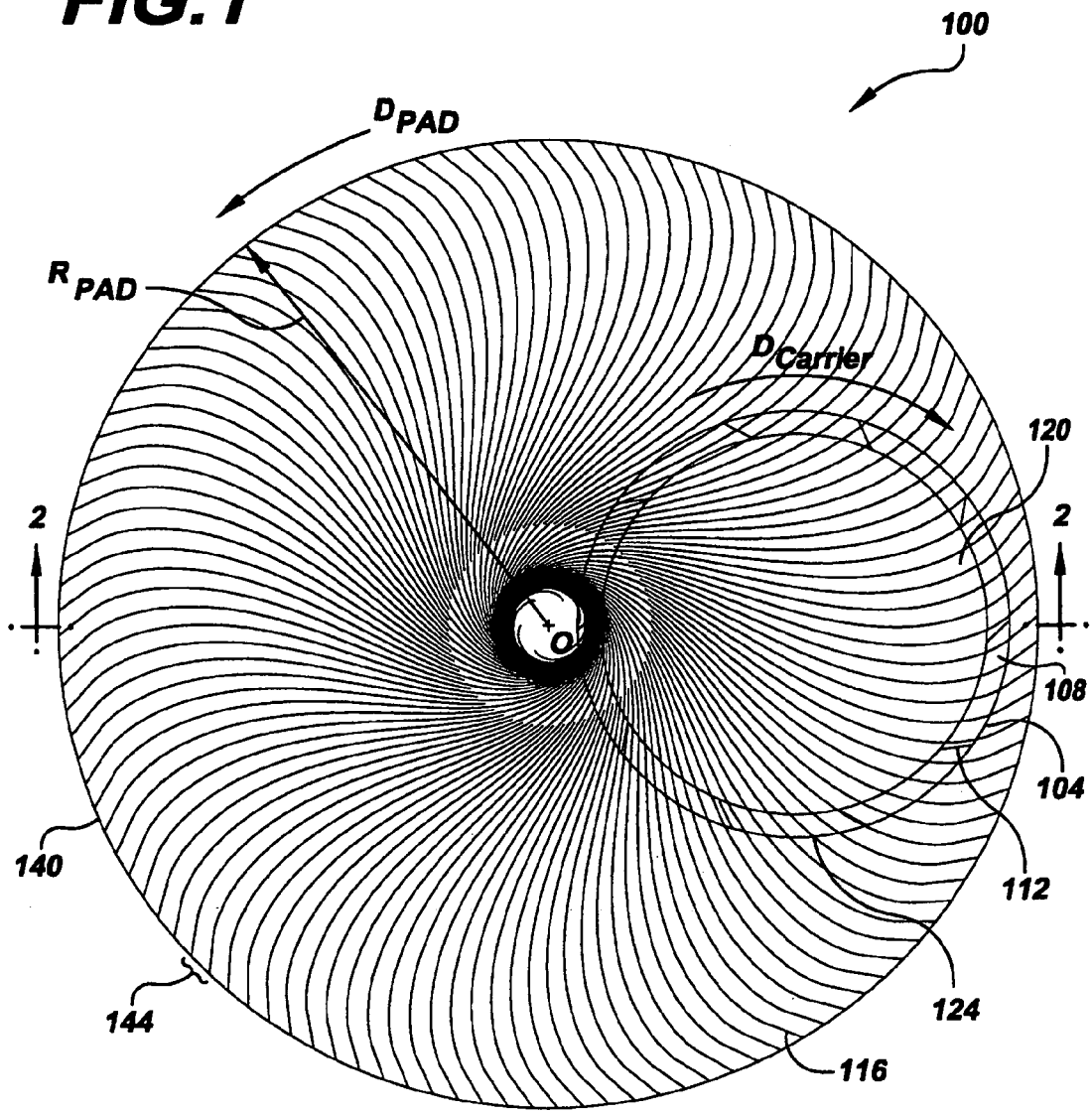
FIG. 1 is a schematic top view of a polishing pad made in accordance with the present invention in the presence of a grooved carrier.

Referring now to the drawings, FIG. 1 illustrates one embodiment of a polishing pad 100 made in accordance with the present invention. As discussed below, polishing pad 100 is particularly designed in coordination with a corresponding respective carrier 104, e.g., a wafer carrier, having a carrier ring 108 containing a plurality of carrier grooves 112 that confront the polishing pad during polishing. More particularly, polishing pad 100 includes a plurality of pad grooves 116 configured to cooperate with carrier grooves 112 so as to allow a polishing medium (not shown), e.g., slurry, to more readily reach an article being polished, e.g., semiconductor wafer 120, as the polishing pad sweeps beneath carrier 104. Generally, this cooperation between pad grooves 116 and carrier grooves 112 occurs in the form of ones of the pad grooves and carrier grooves aligning with one another along at least a portion of the leading edge 124 as polishing pad 100 and carrier 104 are rotated in predetermined directions $D_{pad}$, $D_{Carrier}$, respectively. For purposes of this specification, alignment of the pad grooves and carrier grooves refers to an instantaneous condition during polishing where a continuous path is formed from the polishing pad surface outside the carrier ring to the substrate inside the carrier ring by the overlap of the entire length of a carrier ring groove over at least part of its width with a polishing pad groove such that the available height of the flow channel for polishing medium passing from the outside to the inside of the carrier ring is greater than the height of the carrier groove alone. The alignment of pad grooves 116 and carrier grooves 112 effectively provides larger flow passages across carrier ring 108, due to the adding of the groove volumes of the respective grooves that occurs when the two grooves are in alignment, than would occur without such alignment. Details of various exemplary geometries of pad grooves 116 on polishing pad 100 to suit various geometries of carrier grooves 112 on carrier ring 108 are described below. However, prior to describing the derivation of the geometry of pad grooves 116 and other similar grooves in the exemplary alternative embodiments, some of the physical properties of polishing pad 100 are described next.

Figure 2:
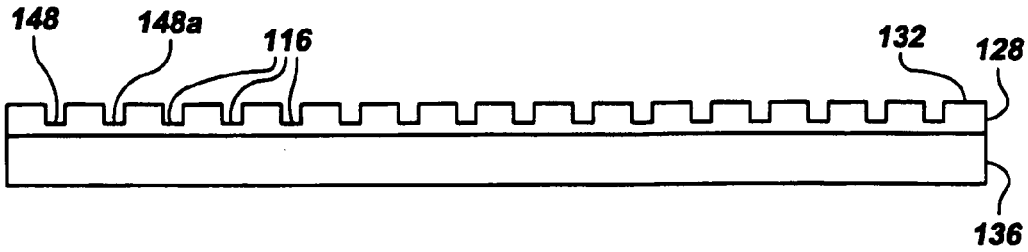
FIG. 2 is an exaggerated cross-sectional view of the polishing pad of FIG. 1 showing as taken along line 2-2 of FIG. 1.

Referring to FIG. 2, and also to FIG. 1, as seen in FIG. 2, polishing pad 100 may further include a polishing layer 128 having a polishing surface 132. In one example, polishing layer 128 may be supported by a backing layer 136, which may be formed integrally with polishing layer 128 or may be formed separately from polishing layer 128. Polishing pad 100 typically has a circular disk shape so that polishing surface 132 has a concentric center O and a circular outer periphery 140. The latter may be located a radial distance from O, as illustrated by radius $R_{Pad}$ of a particular length. At least a portion of the carrier-compatible groove 116 has a radial or curved radial shape. For purposes of the specification, a radial or curved-radial shape is tangent to the radius $R_{Pad}$ of the polishing pad 100 in at least one location along the length of the radius $R_{Pad}$ Polishing layer 128 may be made out of any material suitable for polishing the article being polished, such as a semiconductor wafer, magnetic media article, e.g., a disk of a computer hard drive or an optic, e.g., a refractive lens, reflective lens, planar reflector or transparent planar article, among others. Examples of materials for polishing layer 128 include, for the sake of illustration and not limitation, various polymer plastics, such as a polyurethane, polybutadiene, polycarbonate and polymethylacrylate, among many others.

Pad grooves 116 may be arranged on polishing surface 132 in any of a number of suitable manners. In one example, pad grooves 116 may be the result of repeating a single groove shape circumferentially around concentric center O, e.g., using a constant angular pitch. In another example, which is shown in FIG. 1, pad grooves 116 may be arranged in at least one groove set 144 that is repeated circumferentially around concentric center O, e.g., at a constant angular pitch. In one example, groove set 144 comprises a plurality of individual pad grooves 116 that share a similar shape, but that extend different amounts. As will be appreciated, due to the circular nature of polishing pad 100, the spacing between multiple grooves that extend from proximate concentric center O of the pad near or to outer periphery of the pad and that have a constant angular pitch naturally increases toward the outer periphery of the pad. Consequently, to provide more uniform grooving, in some designs it is desirable to provide polishing pad 100 with more, but shorter, pad grooves 116 when the spacing exceeds a certain amount. It will be readily appreciated that several of groove sets 144 may be formed around concentric center O, as desired.

Further, and referring to FIG. 2 in addition to FIG. 1, each of the plurality of grooves 116 may be formed in polishing layer 128 in any suitable manner, such as by milling, molding, etc. Each of the plurality of pad grooves 116 may be formed with a cross-sectional shape 148 as desired to suit a particular set of design criteria. In one example, each of the plurality of pad grooves 116 may have a rectangular cross-sectional shape, e.g., groove cross-sectional shape 148*a* (FIG. 2). In another example, cross-sectional shape 148 of each pad groove 116 may vary along the length of the groove. In yet another example, cross-sectional shape 148 may vary from one pad groove 116 to another. In still another example, if multiple groove sets 144 are provided, cross-sectional shape 148 may vary from one groove set to another. Those having ordinary skill in the art will understand the wide range of cross-sectional shapes that a designer has in executing cross-sectional shape 148 of pad grooves 116.

Figure 3:
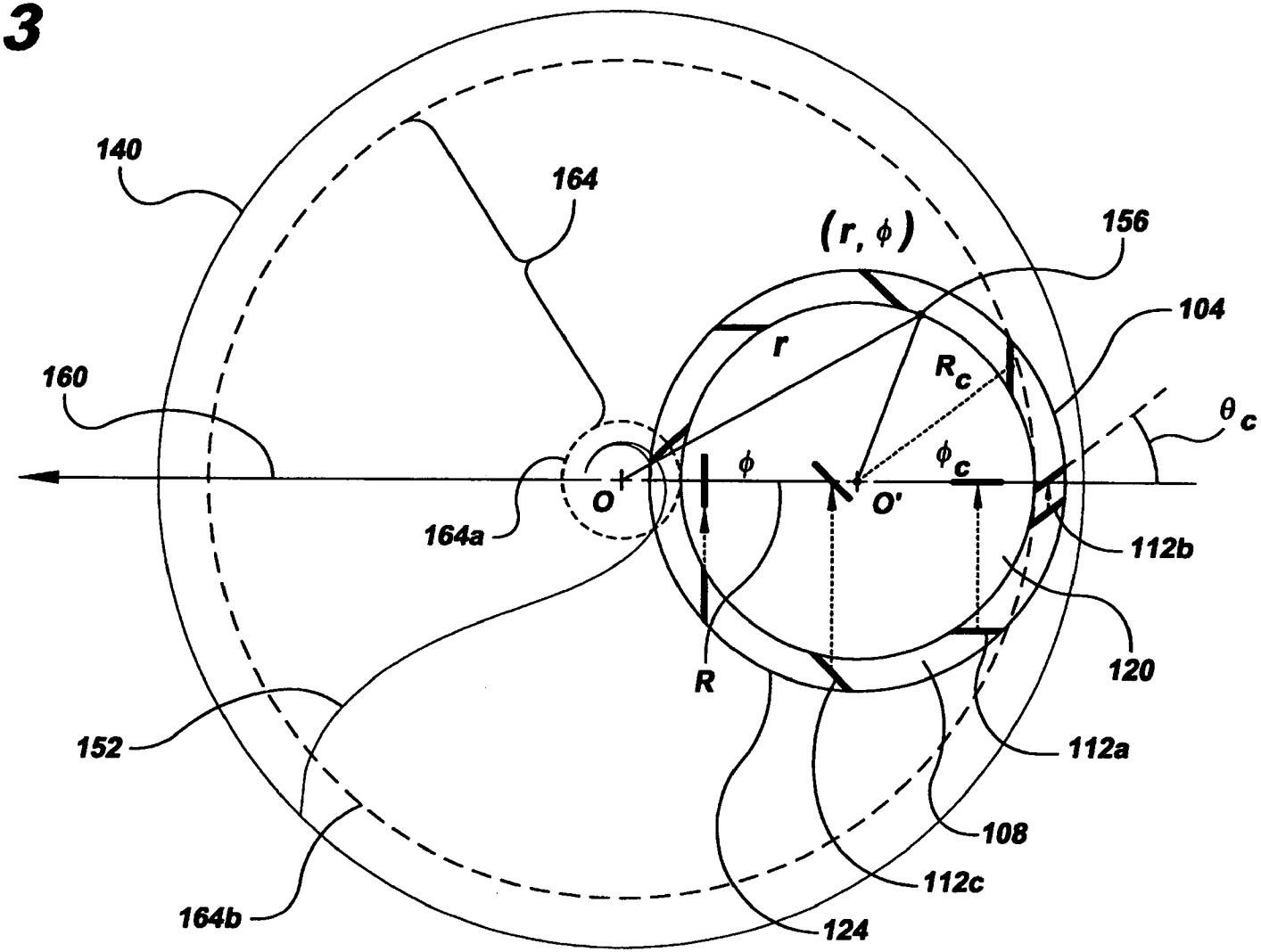
FIG. 3 is a schematic top view illustrating the geometry of the grooves of the polishing pad and grooved carrier of FIG. 1.

Referring now to FIG. 3, each pad groove 116 (FIG. 1) is provided with a carrier-compatible groove shape 152 defined as a function of the configuration of carrier grooves 112. At a high level, carrier-compatible groove shape 152 may be defined by a plurality of points 156 that describe the direction, location and contour of each corresponding groove 116. Each of points 156 may be defined by a local groove angle $\phi$ measured from an axis, such as, for example, a horizontal axis 160 and a pad radius r measured from concentric center O. In one example, carrier-compatible groove shape 152 may be defined over the entire, or substantially the entire, radial distance of polishing surface 132, i.e., $R_{Pad}$. In another example, carrier-compatible groove shape 152 may be defined in relation to the location of the article being polished, e.g., wafer 120. In yet another example, carrier-compatible groove shape 152 may be defined within a portion of a polishing track 164 on polishing surface 132, i.e., the region of the polishing surface that confronts wafer 120, or other article being polished, during polishing. Polishing track 164 may be defined by an inner boundary 164*a* and an outer boundary 164*b*. Those having ordinary skill in the art will readily appreciate that, although inner and outer boundaries 164*a*, 164*b* are largely circular, these boundaries may be undulated in the case of a polisher that imparts an orbital or oscillatory motion to the polished article and/or polishing pad 100.

As mentioned above, carrier-compatible groove shape 152 may be determined as a function of the orientation of carrier grooves 112, which may be considered to be oriented on carrier ring 108 in a manner that forms a local angle $\theta_c$ with an axis, such as, for example, horizontal axis 160. In this case, wherein carrier grooves 112 are oriented as shown, local angle $\theta_c$ of carrier groove 112*a* is 0°, local angle $\theta_c$ of carrier groove 112*b* is 45° and local angle $\theta_c$ of carrier groove 112*c* is −45°. Those skilled in the art will readily recognize how to determine local angle $\theta_c$ for the remaining ones of carrier grooves 112 shown. Local angle $\theta_c$ of carrier grooves of alternative carrier rings having alternative carrier groove orientations can readily be determined in the same manner.

Further, each point along the portion, or whole, of each of carrier groove 112 having carrier-compatible groove shape 152 may be described by a carrier angle $\phi_c$ measured with respect to the rotational center O' of wafer carrier 104 located on horizontal axis 160, and subtended by a carrier radius $R_c$. Typically, carrier radius $R_c$ will denote the outer radius of carrier ring 108 as measured from rotational center O'. Those having ordinary skill in the art will appreciate, however, that carrier radius $R_c$ may alternatively denote a radial distance from rotational center O' to another location on carrier ring 108, such as, for example, the mid-width of carrier ring 108 or the inner radius of the carrier ring, as illustrated in FIG. 3.

Typically, but not necessarily, carrier grooves 112 may be symmetrically arranged on carrier ring 108. In general, a fixed offset exists between local angle $\theta_c$ and carrier angle $\phi_c$, such as, for example, when local angle $\theta_c$ is 45° with respect to horizontal axis 160, carrier angle $\phi_c$ may be expressed generally by Equation 1, below.

$$\phi_c = \theta_c - \frac{\pi}{4} \qquad \text{Equation \{1\}}$$

In addition, pad radius r may be expressed as a function of radial distance R, carrier radius $R_c$ and carrier angle $\theta_c$, as illustrated in the following Equation 2.

$$r=\sqrt{R^2+Rc^2-2RRc\cos(\phi c+\pi)} \qquad \text{Equation \{2\}}$$

It follows that local angle $\theta_c$ may be expressed as a function of pad radius r, carrier radius $R_c$ and radial distance R by combining Equations 1 and 2 to achieve the following Equation 3.

$$\theta_c = \sin^{-1}\sqrt{1-\left(\frac{r^2-R^2-R_c^2}{2RR_c}\right)^2} \quad \text{Equation \{3\}}$$

As described above, a goal of carrier-compatible groove shape 152 is that it aligns with ones of carrier grooves 112 on leading edge 124 of carrier ring 108 at various points along its length as carrier 104 and polishing pad 100 are rotated during polishing. In this manner the overall height of the corresponding respective pad groove 116 is effectively increased by the addition of the height of carrier groove 112 as the two grooves sweep past one another. In this example, the alignment of carrier-compatible groove shape 152 and carrier groove 112 on leading edge 124 of carrier ring 108 may be achieved by making local groove angle $\phi$ equal to carrier angle $\phi_c$. Globally, this equivalence may be obtained by taking incremental radial steps directed at local groove angle $\phi$, as illustrated in Equation 4, below.

$$\tan\theta_c = r\frac{d\phi}{dr} \quad \text{Equation \{4\}}$$

These incremental steps may be made to form a continuous groove trajectory by integrating the local groove angle $\phi$ from O to outer periphery 140 over radius $R_{Pad}$. This integration provides carrier-compatible groove shape 152 as a series of points (r, $\phi$) (not shown) as prescribed by Equation 5, below. Each of pad grooves 116 of FIG. 1 is laid out in accordance with Equation 5 along its entire length, i.e., the entire length of each pad groove is laid out in accordance with carrier-compatible groove shape 152 of FIG. 3.

$$\phi(r) = \int_0^{R_{Pad}} \frac{u+\sqrt{1-u^2}+\left(\frac{2RR_c}{r^2+R^2-R_c^2}\right)\sqrt{1-u^2}\left(u-\sqrt{1-u^2}\right)}{u-\sqrt{1-u^2}-\left(\frac{2RR_c}{r^2+R^2-R_c^2}\right)\sqrt{1-u^2}\left(u+\sqrt{1-u^2}\right)}\frac{dr}{r} \quad \text{Equation \{5\}}$$

$$\text{where } u = \frac{R^2+R_c^2-r^2}{2RR_c}.$$

FIGS. 4-7 illustrate two alternative carrier-compatible polishing pads 200, 300 made in accordance with the general principles discussed above relative to polishing pad 100 of FIG. 1. Generally, these embodiments illustrate carrier-compatible groove shapes, and the corresponding respective grooves, that result from exemplary carrier rings that include carrier grooves having local angles $\theta_c$ other than 45° with respect to horizontal axis 160.

Figure 4:
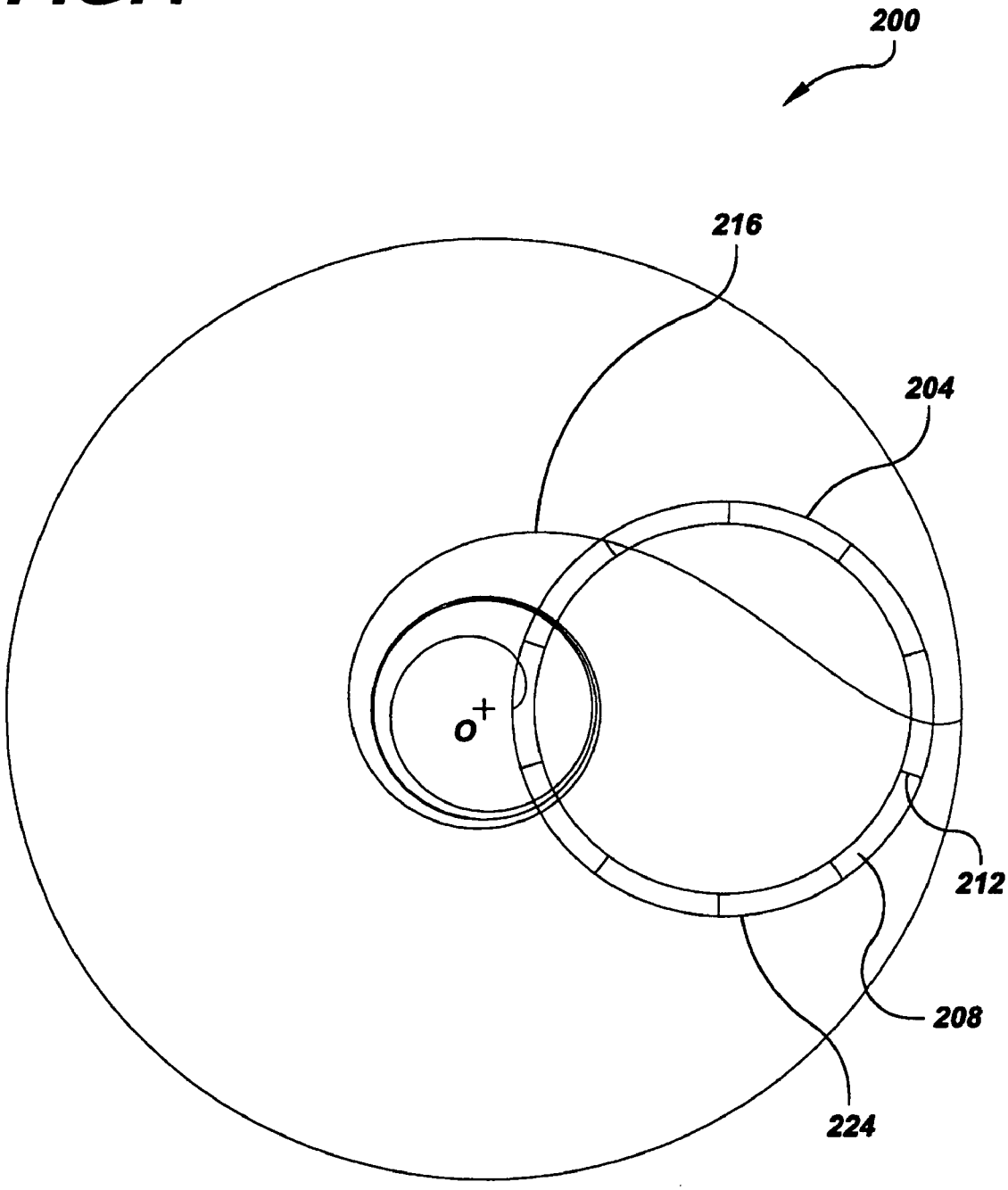
FIG. 4 is a schematic top view of an alternative polishing pad made in accordance with the present invention showing one groove.
Figure 5:
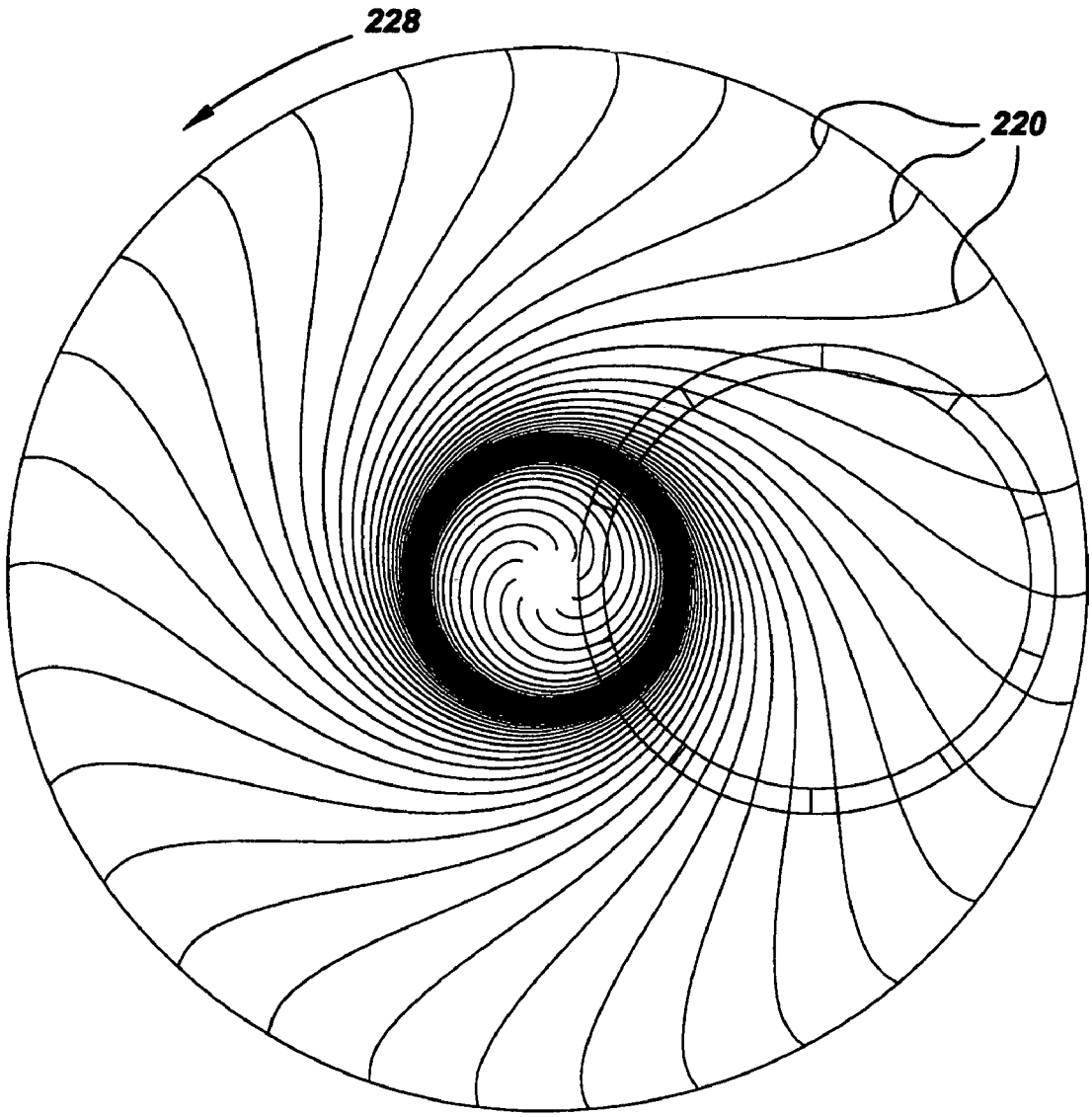
FIG. 5 is a plan view of the polishing pad of FIG. 4 showing the complete formation of the polishing pad.

In the embodiment of FIGS. 4 and 5, carrier 204 includes a carrier ring 208 having carrier grooves 212 having a uniform local angle $\theta_c$ of 0° with respect to horizontal axis 160. For the illustrated carrier grooves 212 (FIG. 5), the corresponding carrier-compatible groove shape 216 determined using Equation 5 is shown in FIG. 5. In accordance with the general principles described above, carrier-compatible groove shape 216 may be used to lay out a plurality of pad grooves 220 (FIG. 4) that will align with carrier grooves 216 on the leading edge 224 of carrier ring 208 as carrier 204 is rotated and polishing pad 200 is rotated in the direction 228 shown on FIG. 4. It will be readily appreciated that the set of pad grooves 220 in FIG. 4 are the result of repeating carrier-compatible groove shape 216 (FIG. 5) circumferentially around polishing pad 200 at a constant angular pitch. Of course, in other embodiments, additional, but shorter, grooves (not shown) may be provided as desired to reduce the space between adjacent ones of pad grooves 220. These additional grooves may or may not include carrier-compatible groove shape 216.

It is noted that, like pad grooves 116 of FIG. 1, pad grooves 220 of FIG. 4 have carrier-compatible groove shape 216 along their entire lengths. Of course, in other embodiments, this need not be so. For example, it may be desirable to have only the middle two-thirds of the polishing track (see FIG. 3, element 164) contain carrier-compatible groove shape 216. Another example is to have carrier-compatible groove shape 216 with pad groove-carrier groove alignment across at least 50% of the polishing track. For example, the carrier-compatible groove shape 216 may traverse at least 50% or 80% of the polishing track. In this case, the portions of each pad groove 220 radially inward and outward of the portion of that groove having groove shape 216, if any, may be any shape desired. Other physical aspects of polishing pad 200 may be the same as the physical aspects described above relative to polishing pad 100.

Figure 6:
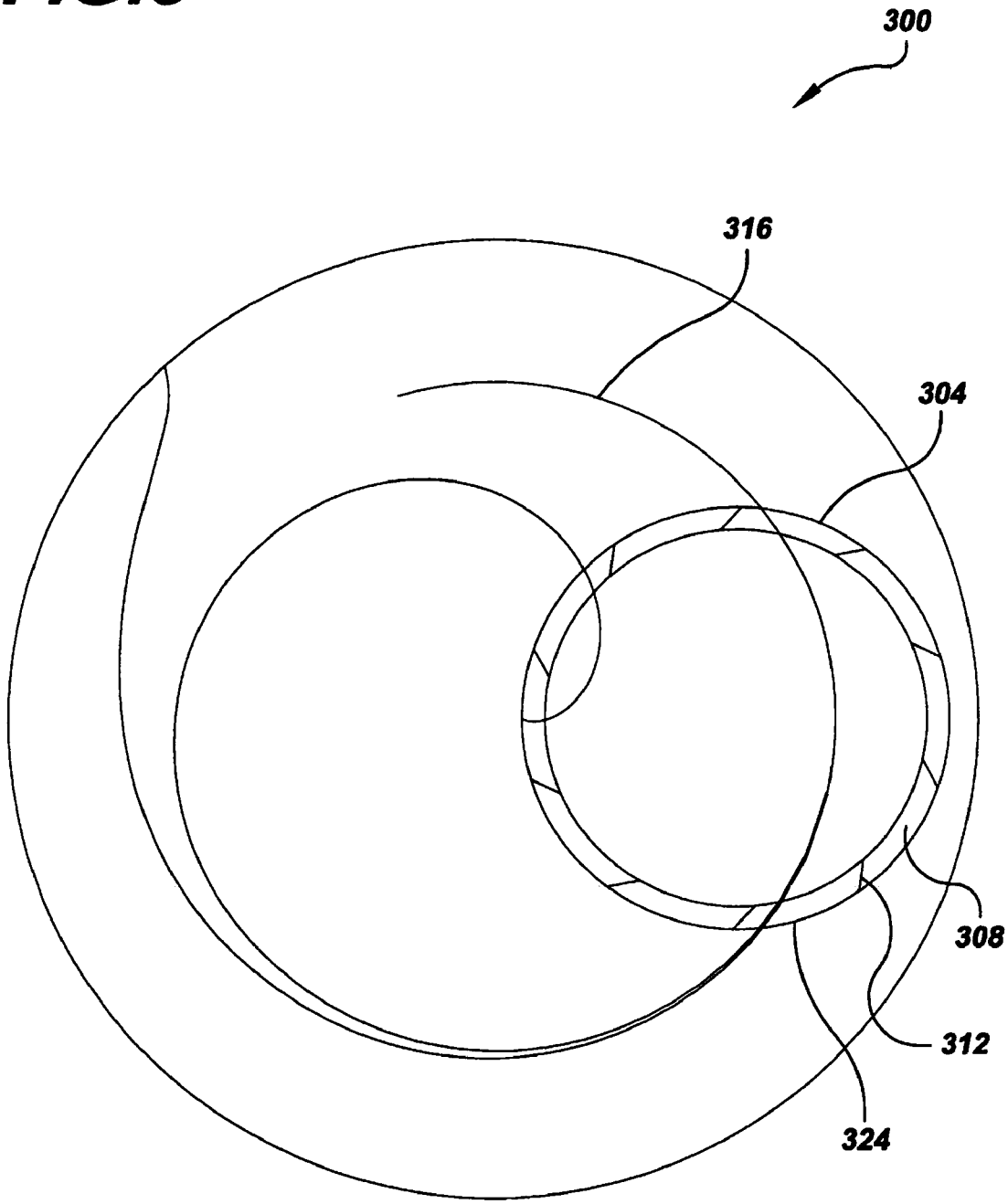
FIG. 6 is a schematic top view of an alternative polishing pad made in accordance with the present invention showing one groove.
Figure 7:
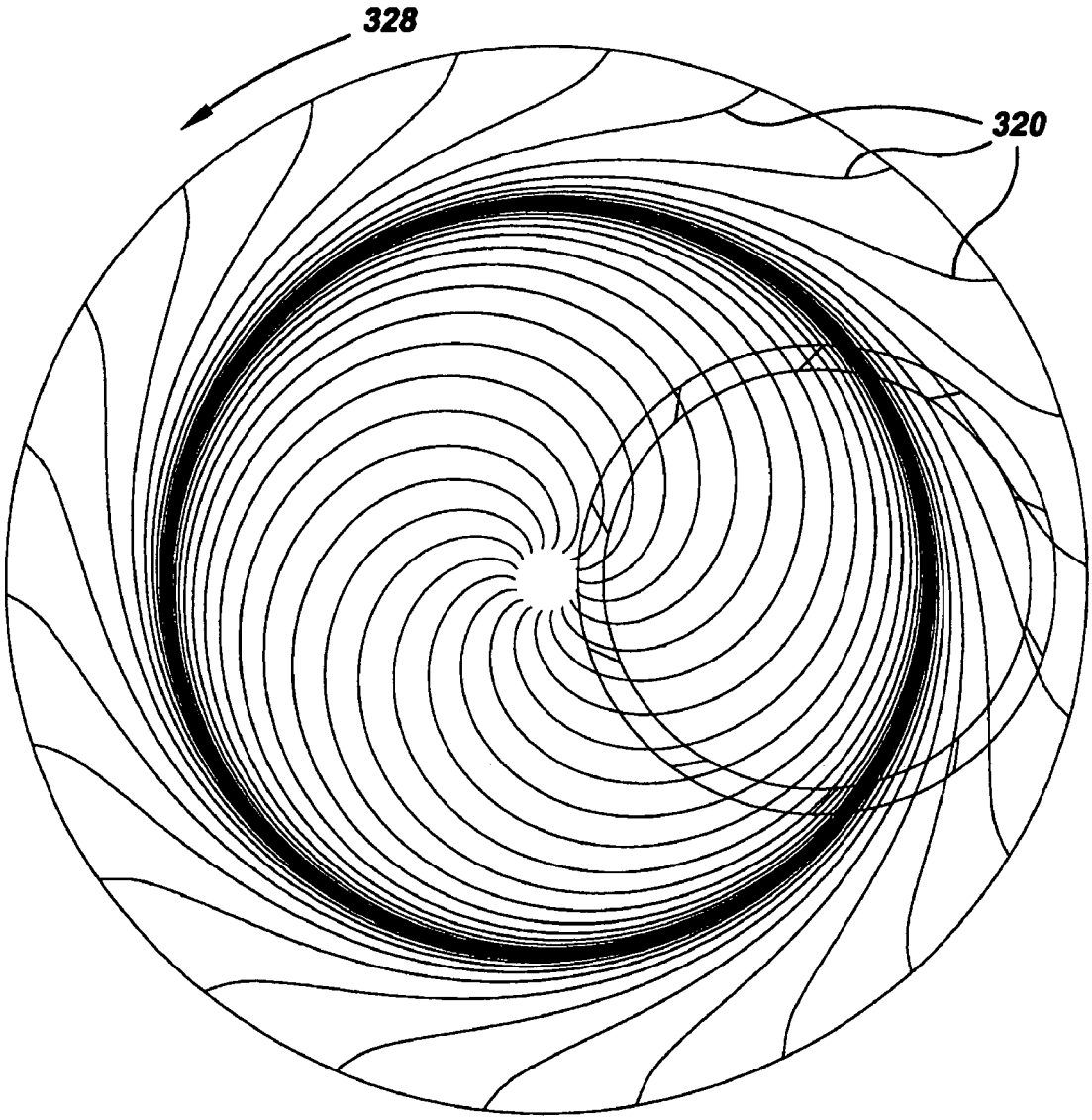
FIG. 7 is a plan view of the polishing pad of FIG. 6 showing the complete formation of the polishing pad.

Referring now to FIGS. 6 and 7, the carrier 304 of this embodiment includes a carrier ring 308 having carrier grooves 312 having a uniform local angle $\theta_c$ of −45° with respect to horizontal axis 160, that is, a local angle $\theta_c$ approximately reversed that shown in FIG. 1. For the illustrated carrier grooves 312, the corresponding carrier-compatible groove shape 316 determined using Equation 5 is shown in FIG. 7. Again, in accordance with the general principles described above, carrier-compatible groove shape 316 may be used to lay out a plurality of pad grooves 320 (FIG. 6) that will align with carrier grooves 316 on the leading edge 324 of carrier ring 308 as carrier 304 is rotated and polishing pad 300 is rotated in the direction 328 shown on FIG. 6. It will be readily appreciated that the set of pad grooves 320 in FIG. 6 are the result of repeating carrier-compatible groove shape 316 (FIG. 7) circumferentially around polishing pad 300 at a constant angular pitch. Of course, in other embodiments, additional, but shorter, grooves (not shown) may be provided as desired to reduce the space between adjacent ones of pad grooves 320. These additional grooves may or may not include carrier-compatible groove shape 316.

It is noted that, like pad grooves 116 of FIG. 1, pad grooves 320 of FIG. 6 have carrier-compatible groove shape 316 along their entire lengths. Of course, in other embodiments, this need not be so. For example, it may be desirable to have only the middle two-thirds of the polishing track (see FIG. 3, element 164) contain carrier-compatible groove shape 316. In this case, the portions of each pad groove 320 radially inward and outward of the portion of that groove having groove shape 316, if any, may be any shape desired. Other physical aspects of polishing pad 300 may be the same as the physical aspects described above relative to polishing pad 100.

Generally, Equation 5, above, is based on determining the proper carrier-compatible groove shape based on the actual locations of the carrier grooves on the leading edge of the carrier ring. Consequently, Equation 5 provides highly accurate carrier-compatible groove shapes. However, it is noted that there are alternative ways to determine satisfactory carrier-compatible groove shapes that achieve the desired results of increasing the amount of polishing medium reaching the article being polished via the leading edge of a grooved carrier ring. For example, and referring back to FIG. 3, an alternative carrier-compatible groove shape (not shown) may be approximately determined according to the orientation of carrier grooves 112 when the carrier grooves are projected from leading edge 124 onto horizontal axis 160, e.g., as projected carrier grooves 112*a*', 112*b*', 112*c*', 112*d*'. In this alternative, pad radius r is expressed generally as a function of radial distance R, carrier radius $R_c$ and carrier angle $\phi_c$, as illustrated in the following Equation 6.

$$r=R+R_c\cos\phi_c \qquad \text{Equation \{6\}}$$

It follows that local angle $\theta_c$ may be expressed as a function of pad radius r, carrier radius $R_c$ and radial distance R by combining Equations 1 and 2, as illustrated in Equation 7.

$$\theta_c=\frac{\pi}{4}+\cos^{-1}\left(\frac{r-R}{R_c}\right) \qquad \text{Equation \{7\}}$$

In this alternative, the integration of local groove angle $\phi$ from O to outer periphery 140 over radius $R_{Pad}$ prescribes a carrier-compatible groove shape as a series of points (r, $\phi$) (not shown) defined by Equation 8.

$$\phi(r)=\frac{\int_0^{R_{pad}}(r-R)-R_c\sqrt{1-\left(\frac{r-R}{R_c}\right)^2}}{(r-R)+R_c\sqrt{1-\left(\frac{r-R}{R_c}\right)^2}}\frac{dr}{r} \qquad \text{Equation \{8\}}$$

FIGS. 8-13 illustrate three alternative carrier-compatible polishing pads 400, 500, 600 made in accordance with the general principles discussed above relative to polishing pad 100 of FIG. 1 and which have carrier-compatible groove shapes based on the projected locations of the carrier grooves on the leading edge of the carrier ring. Generally, these embodiments illustrate carrier-compatible groove shapes, and the corresponding respective grooves, that result from exemplary carrier rings.

Figure 8:
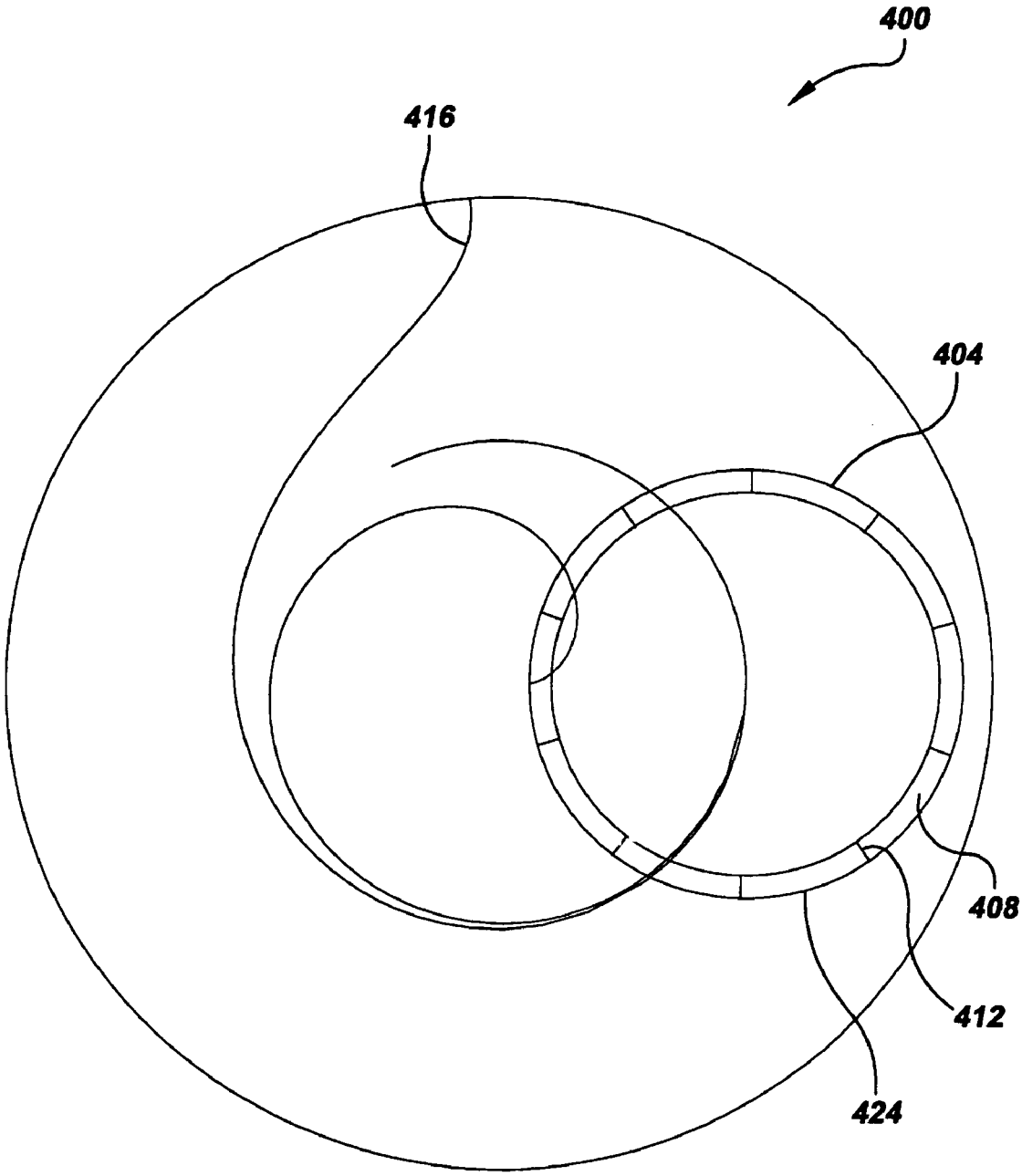
FIG. 8 is a schematic top view of another alternative polishing pad made in accordance with the present invention showing one groove.
Figure 9:
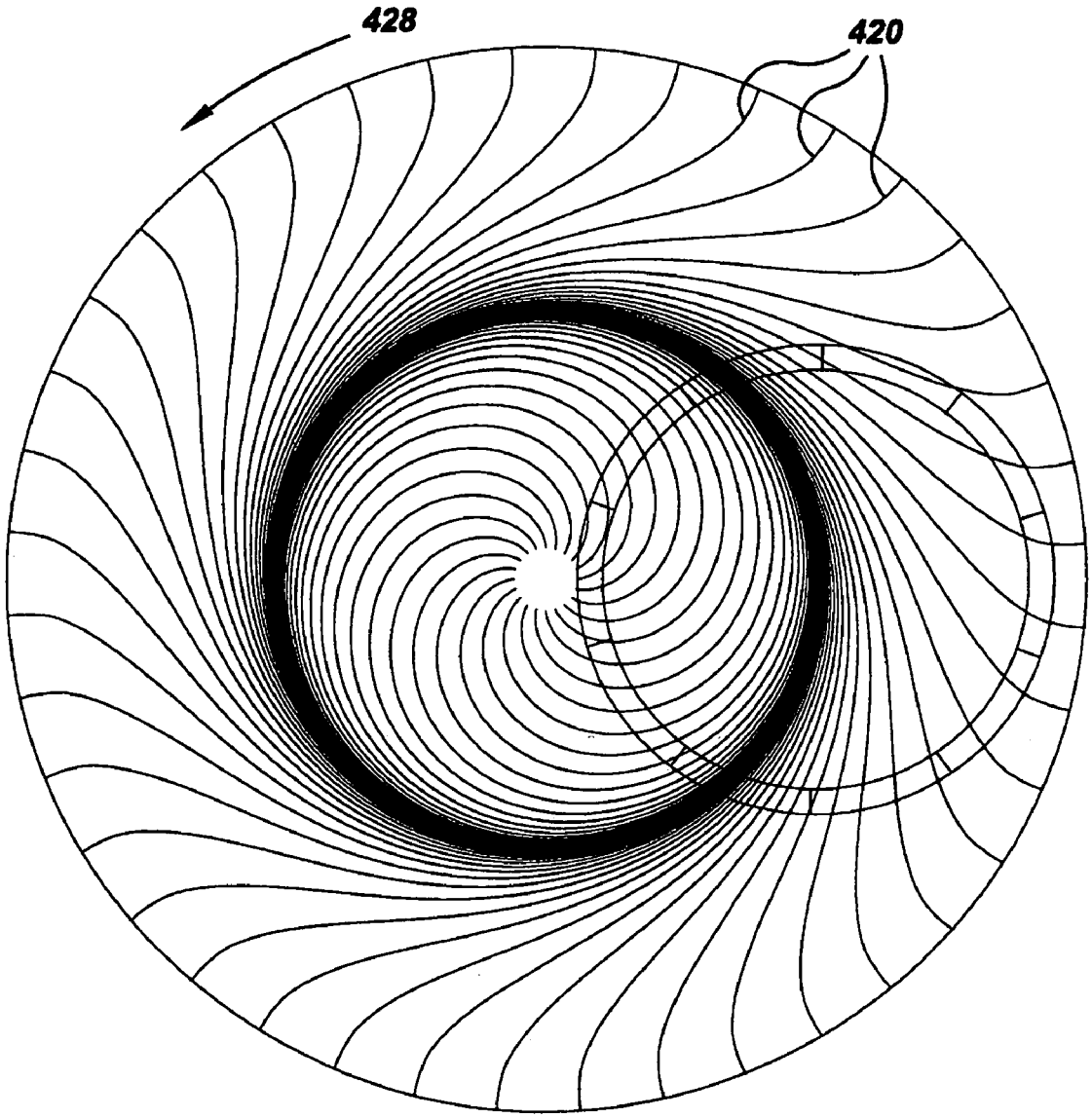
FIG. 9 is plan view of the polishing pad of FIG. 8 showing the complete formation of the polishing pad.

Referring back to the drawings, FIGS. 8 and 9 illustrate an embodiment having a carrier 404 that includes a carrier ring 408 having carrier grooves 412 having a uniform local angle $\theta_c$ of 0° with respect to horizontal axis 160. For the illustrated carrier grooves 412, the corresponding carrier-compatible groove shape 416 determined using Equation 8 is shown in FIG. 9. Again, in accordance with the general principles described above, carrier-compatible groove shape 416 may be used to lay out a plurality of pad grooves 420 (FIG. 8) that will align with carrier grooves 416 on the leading edge 424 of carrier ring 408 as carrier 404 is rotated and polishing pad 400 is rotated in the direction 428 shown on FIG. 8. It will be readily appreciated that the set of pad grooves 420 in FIG. 8 are the result of repeating carrier-compatible groove shape 416 (FIG. 9) circumferentially around polishing pad 400 at a constant angular pitch. Of course, in other embodiments, additional, but shorter, grooves (not shown) may be provided as desired to reduce the space between adjacent ones of pad grooves 420. These additional grooves may or may not include carrier-compatible groove shape 416.

It is noted that, like pad grooves 116 of FIG. 1, pad grooves 420 of FIG. 8 have carrier-compatible groove shape 416 along their entire lengths. Of course, in other embodiments, this need not be so. For example, it may be desirable to have only the middle two-thirds of the polishing track (see FIG. 3, element 164) contain carrier-compatible groove shape 416. In this case, the portions of each pad groove 420 radially inward and outward of the portion of that groove having groove shape 416, if any, may be any shape desired. Other physical aspects of polishing pad 400 may be the same as the physical aspects described above relative to polishing pad 100.

Figure 10:
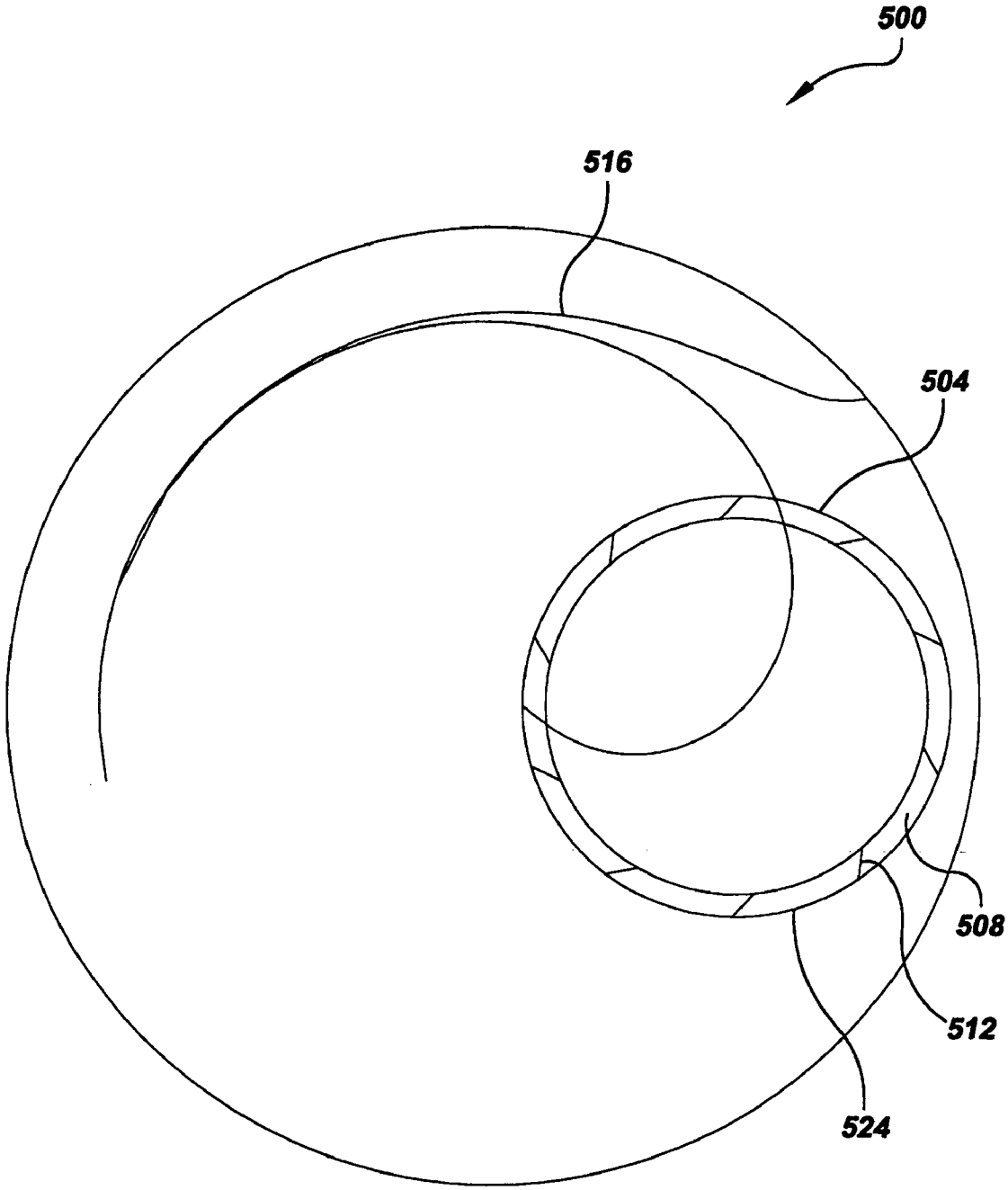
FIG. 10 is a schematic top view of yet another alternative polishing pad made in accordance with the present invention showing one groove.
Figure 11:
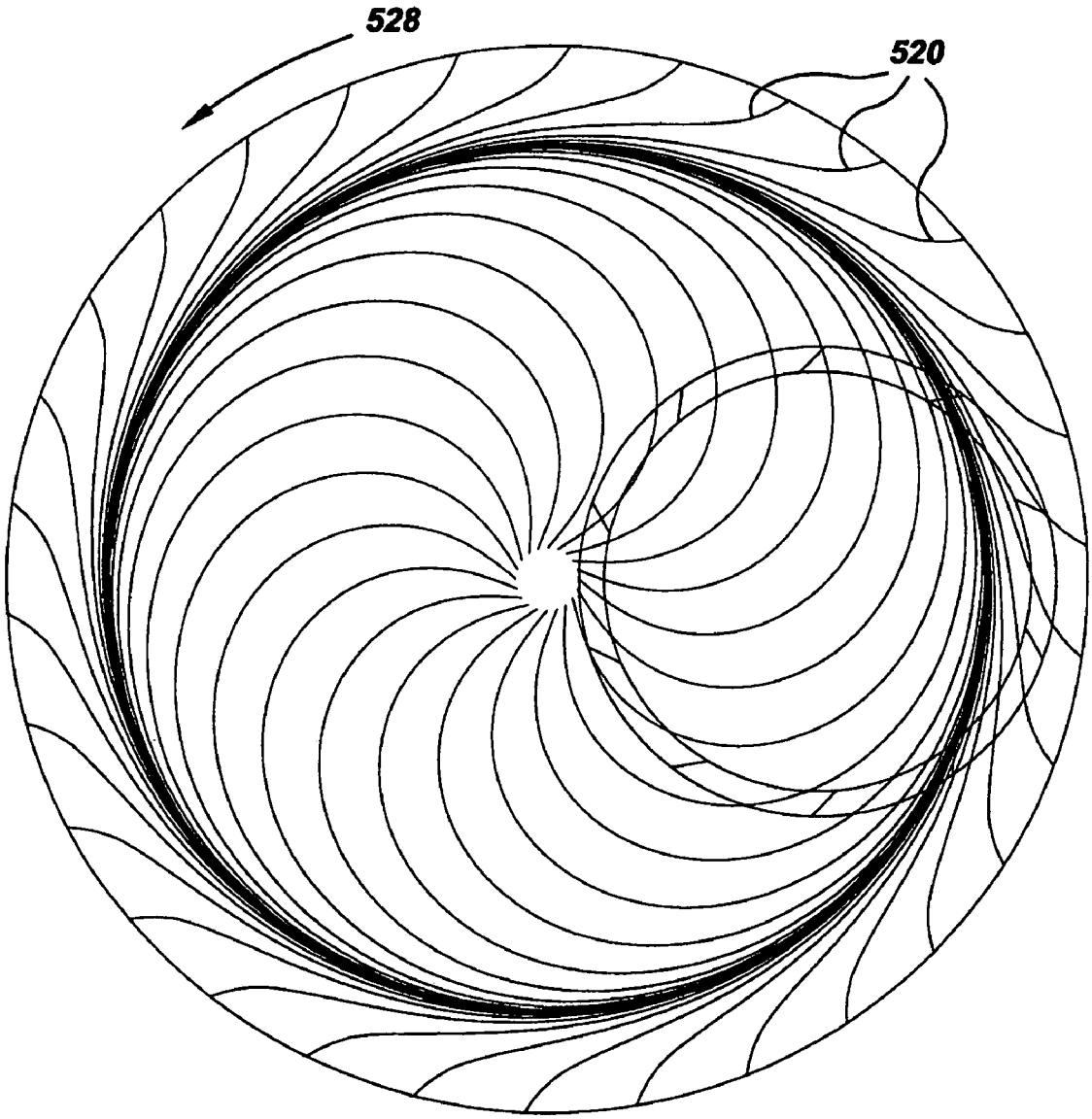
FIG. 11 is a plan view of the polishing pad of FIG. 10 showing the complete formation of the polishing pad.

In the embodiment of FIGS. 10 and 11, carrier 504 includes a carrier ring 508 having carrier grooves 512 having a uniform local angle $\theta_c$ of −45° with respect to horizontal axis 160. For the illustrated carrier grooves 512 (FIG. 11), the corresponding carrier-compatible groove shape 516 determined using Equation 8 is shown in FIG. 11. In accordance with the general principles described above, carrier-compatible groove shape 516 may be used to lay out a plurality of pad grooves 520 (FIG. 10) that will align with carrier grooves 516 on the leading edge 524 of carrier ring 508 as carrier 504 is rotated and polishing pad 500 is rotated in the direction 528 shown on FIG. 10. It will be readily appreciated that the set of pad grooves 520 in FIG. 10 are the result of repeating carrier-compatible groove shape 516 (FIG. 11) circumferentially around polishing pad 500 at a constant angular pitch. Of course, in other embodiments, additional, but shorter, grooves (not shown) may be provided as desired to reduce the space between adjacent ones of pad grooves 520. These additional grooves may or may not include carrier-compatible groove shape 516.

It is noted that, like pad grooves 116 of FIG. 1, pad grooves 520 of FIG. 10 have carrier-compatible groove shape 516 along their entire lengths. Of course, in other embodiments, this need not be so. For example, it may be desirable to have only the middle two-thirds of the polishing track (see FIG. 3, element 164) contain carrier-compatible groove shape 516. In this case, the portions of each pad groove 520 radially inward and outward of the portion of that groove having groove shape 516, if any, may be any shape desired. Other physical aspects of polishing pad 500 may be the same as the physical aspects described above relative to polishing pad 100.

Figure 12:
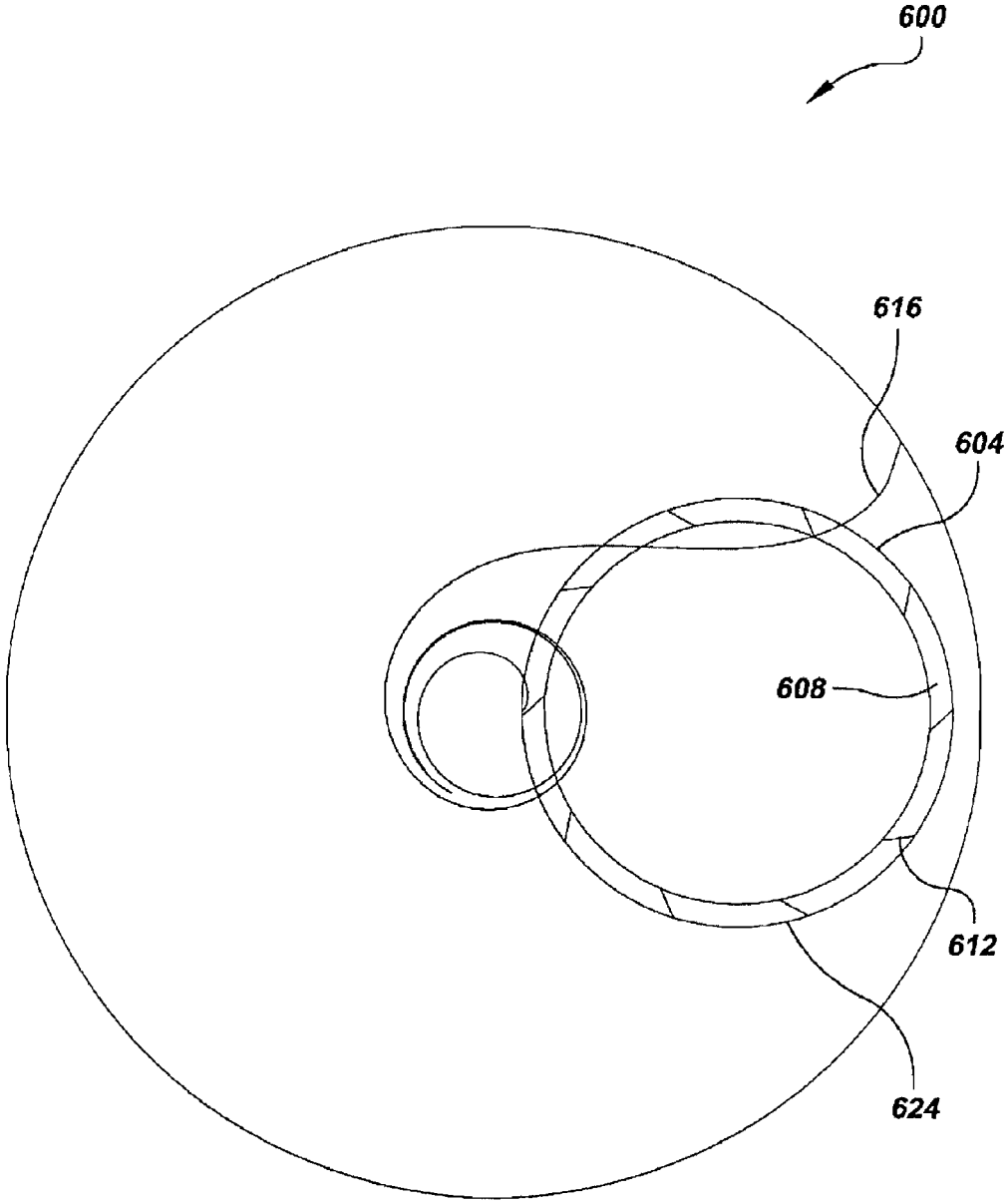
FIG. 12 is a schematic top view of still another alternative polishing pad made in accordance with the present invention showing one groove.
Figure 13:
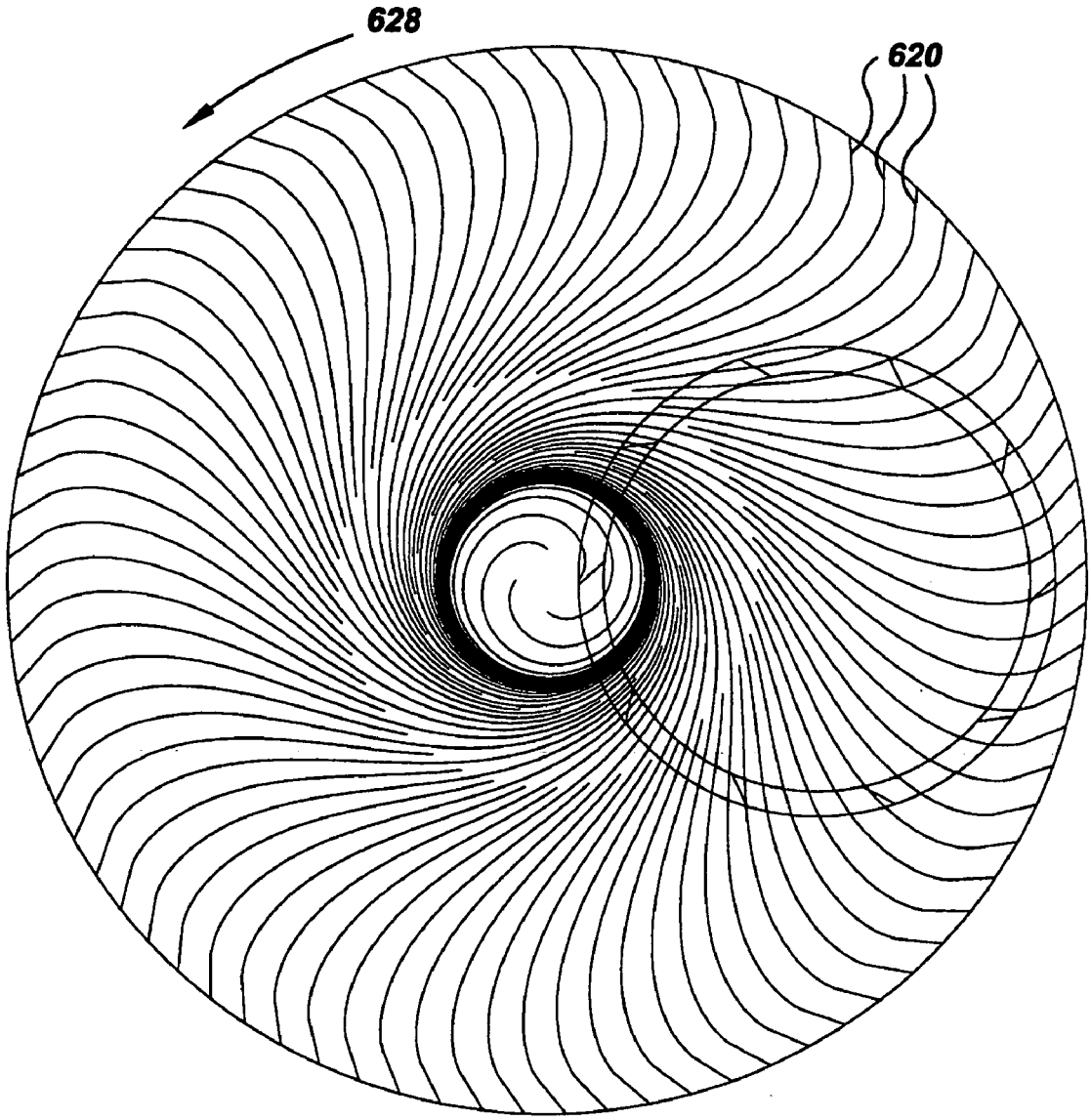
FIG. 13 is a plan view of the polishing pad of FIG. 12 showing the complete formation of the polishing pad.

FIGS. 12 and 13 illustrate another embodiment having a carrier 604 that includes a carrier ring 608 having carrier grooves 612 having a uniform local angle $\theta_c$ of 45° with respect to horizontal axis 160. For the illustrated carrier grooves 612, the corresponding carrier-compatible groove shape 616 determined using Equation 8 is shown in FIG. 13. Again, in accordance with the general principles described above, carrier-compatible groove shape 616 may be used to lay out a plurality of pad grooves 620 (FIG. 12) that will align with carrier grooves 616 on the leading edge 624 of carrier ring 608 as carrier 604 is rotated and polishing pad 600 is rotated in the direction 628 shown on FIG. 12. It will be readily appreciated that the set of pad grooves 620 in FIG. 12 are the result of repeating carrier-compatible groove shape 616 (FIG. 13) circumferentially around polishing pad 600 at a constant angular pitch. Of course, in other embodiments, additional, but shorter, grooves (not shown) may be provided as desired to reduce the space between adjacent ones of pad grooves 620. These additional grooves may or may not include carrier-compatible groove shape 616.

It is noted that, like pad grooves 116 of FIG. 1, pad grooves 620 of FIG. 12 have carrier-compatible groove shape 616 along their entire lengths. Of course, in other embodiments, this need not be so. For example, it may be desirable to have only the middle two-thirds of the polishing track (see FIG. 3, element 164) contain carrier-compatible groove shape 616. In this case, the portions of each pad groove 620 radially inward and outward of the portion of that groove having groove shape 616, if any, may be any shape desired. Other physical aspects of polishing pad 600 may be the same as the physical aspects described above relative to polishing pad 100.

Figure 14:
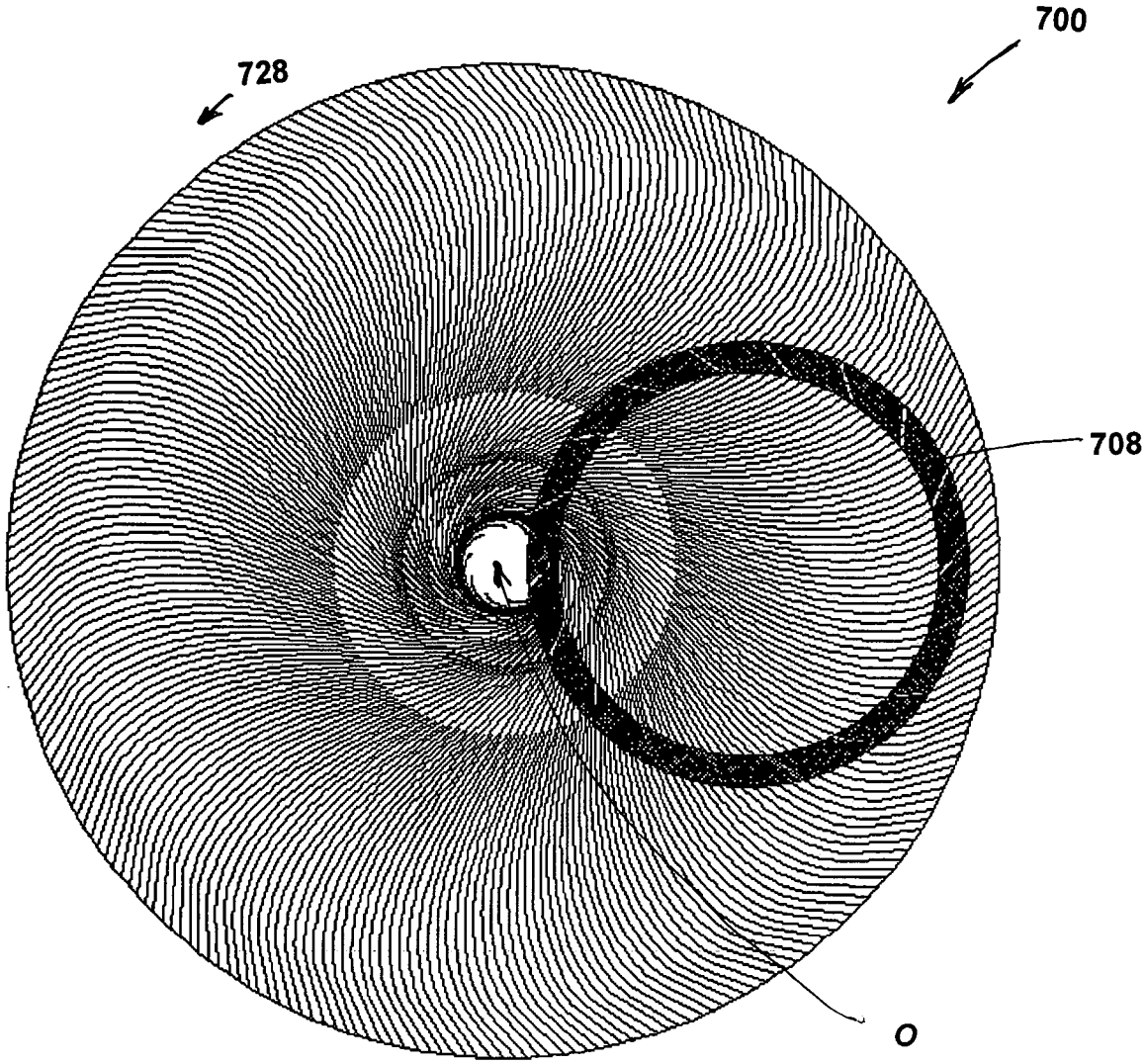
FIG. 14 is a schematic top view of still another alternative polishing pad made in accordance with the present invention showing partial pad-carrier groove alignment.
Figure 15:
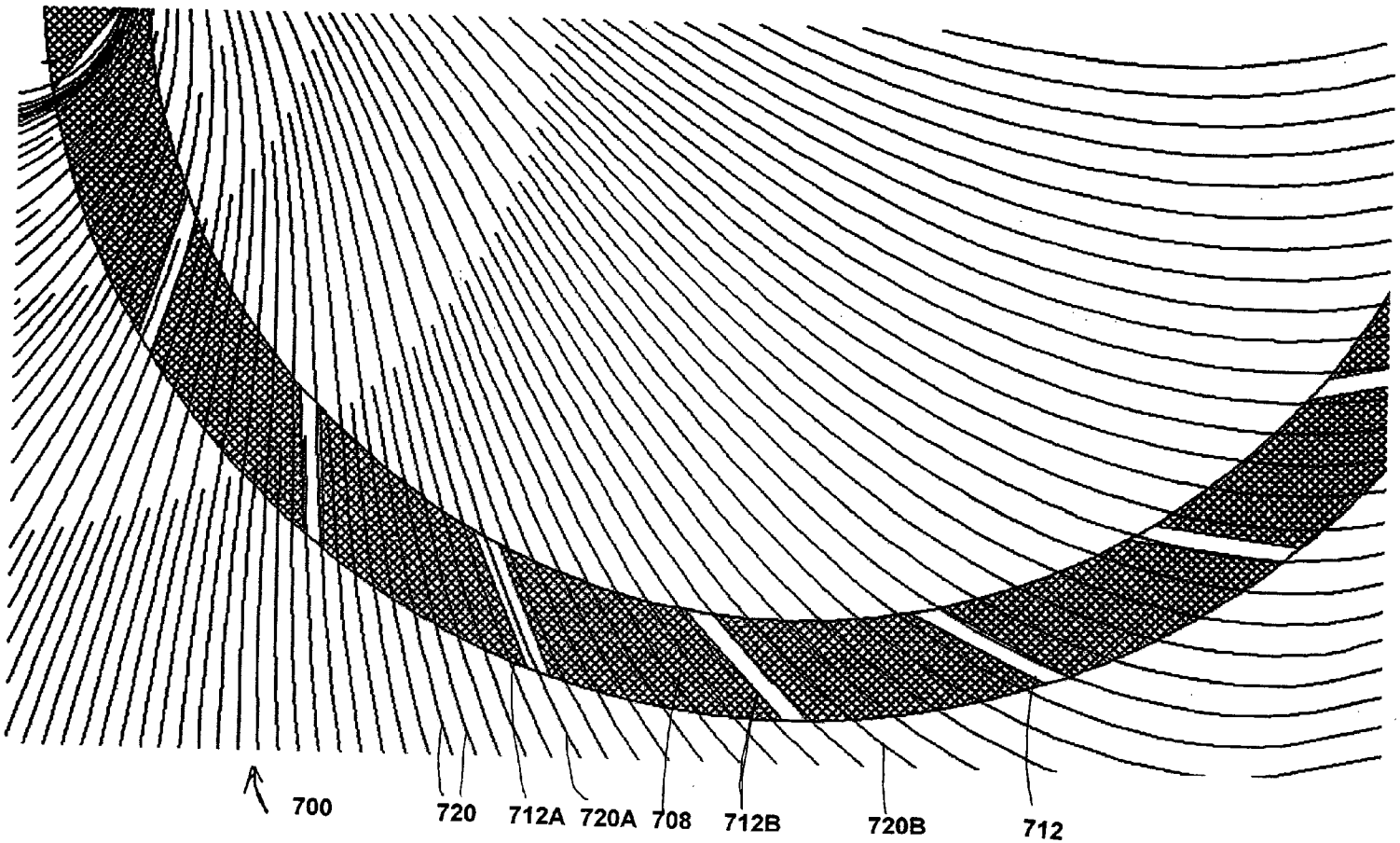
FIG. 15 is an enlarged partial view of the polishing pad of FIG. 14 illustrating the partial pad-carrier groove alignment.

FIGS. 14 and 15 illustrate an embodiment with partial alignment between the polishing pad 700 and carrier ring 708 in accordance with the embodiment of equation 5. Polishing pad 700 contains multiple sets of grooves 720 having different lengths for increasing the uniformity of groove density throughout the polishing pad. In particular, pad grooves 720 terminate at different radial distances from the center O of polishing pad 700 to provide uniformity and prevent the grooves from overlapping near the center O. During polishing, three conditions occur between pad grooves 720 and carrier grooves 712 as follows: first, some pad grooves 720A become in full alignment with carrier grooves 712A; second, some carrier grooves 712B fail to align with and pad grooves 720; and third, some pad grooves 720B fail to align with carrier grooves 712. As the pad 700 and the carrier ring 708 rotate in direction 728, each carrier groove 712 periodically switches between alignment with pad grooves 720 and no alignment with pad grooves 720. The efficacy of this embodiment is to allow a partial increase in slurry flow when at least one groove 720 aligns with at least one carrier ring groove 712. In addition to this embodiment that has full alignment along a groove length, it is also possible to use this pad groove-carrier groove configuration with an embodiment of only partial alignment along the length of the pad groove, such as that arising from equation 8.

Figure 16:
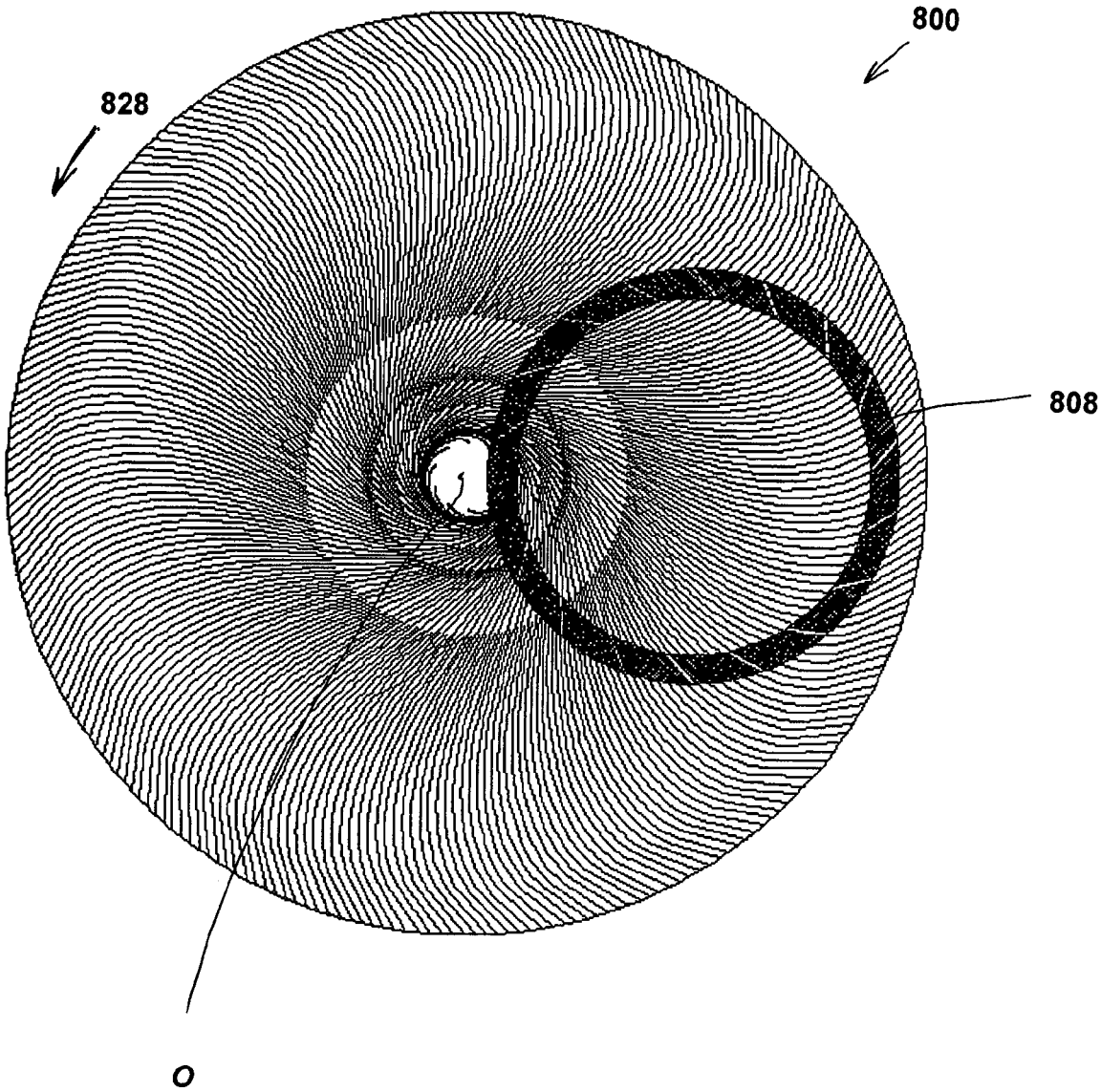
FIG. 16 is a schematic top view of still another alternative polishing pad made in accordance with the present invention showing complete pad-carrier groove alignment.
Figure 17:
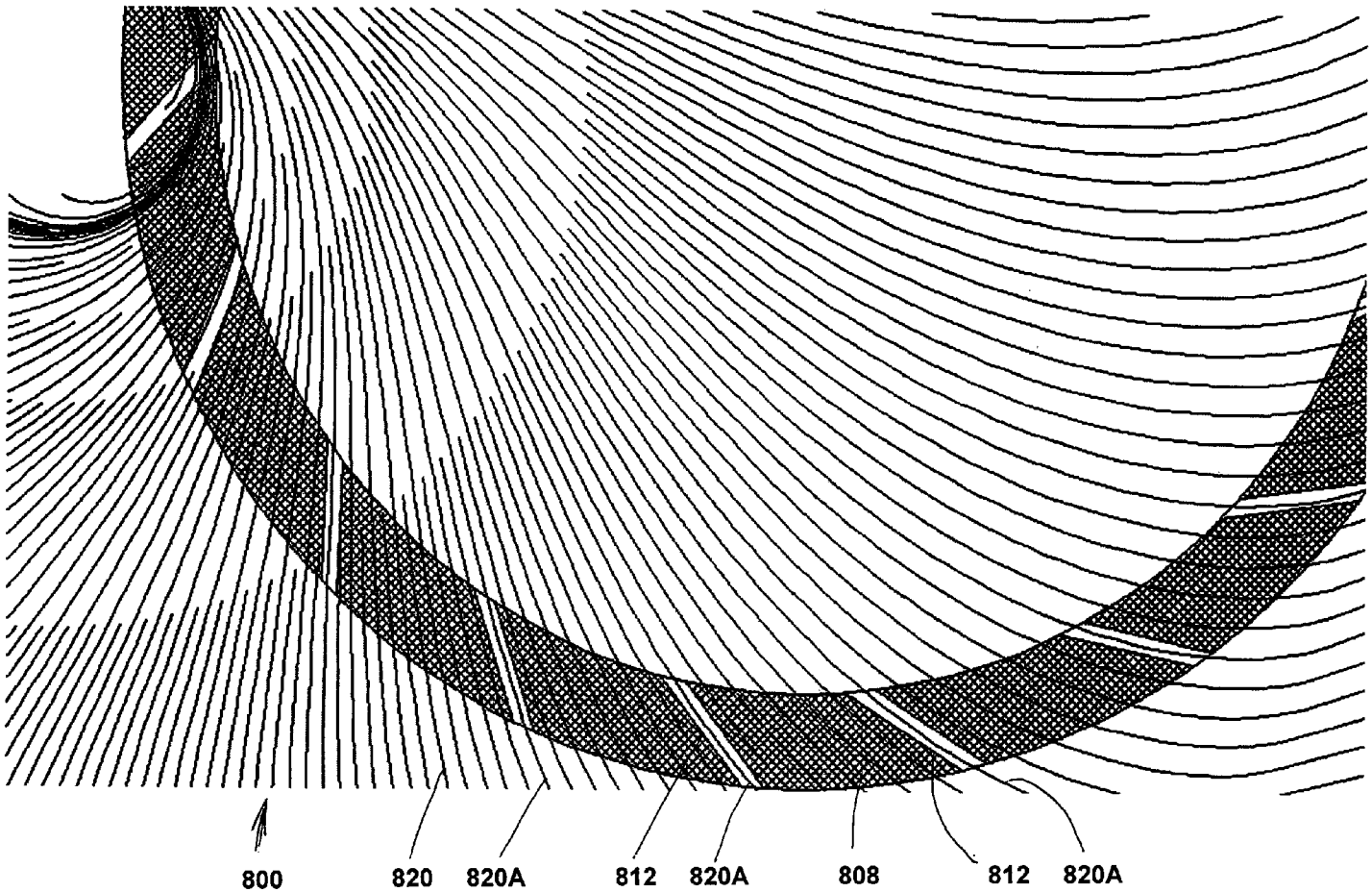
FIG. 17 is an enlarged partial view of the polishing pad of FIG. 16 illustrating the complete pad-carrier groove alignment.

FIGS. 16 and 17 illustrate an embodiment with complete periodic alignment between the polishing pad 800 and carrier ring 808 in accordance with the embodiment of equation 5. Polishing pad 800 contains multiple sets of grooves 820 having different lengths for increasing the uniformity of groove density throughout the polishing pad. In particular, pad grooves 820 terminate at different radial distances from the center O of polishing pad 800 to provide uniformity and prevent the grooves from overlapping near the center O. During polishing, two conditions occur between pad grooves 820 and carrier grooves 812 as follows: first, all carrier grooves 812 simultaneously become in full alignment with pad grooves 820A and then all carrier grooves 812 fail to align with any pad grooves 820. As the pad 800 and the carrier ring 808 rotate in direction 828, all carrier groove 812 periodically switch between being in simultaneous alignment with pad grooves 820 and being in simultaneous non-alignment with pad grooves 820. The efficacy of this embodiment is to allow a periodic or pulsed increase in slurry flow when all carrier grooves 812 align with pad grooves 820. This embodiment can augment slurry flow at discrete intervals through all the leading edge carrier grooves 812. This mode of slurry ingress may be advantageous in CMP systems with slurry chemistries that operate more favorably in the presence of some chemical by-products or where periodic upward swings of temperature contribute to increasing chemical activity or reaction kinetics. In addition to this embodiment that has full alignment along a groove length, it is also possible to use this pad groove-carrier groove configuration with an embodiment of only partial alignment along the length of the pad groove, such as that arising from equation 8.

Figure 18:
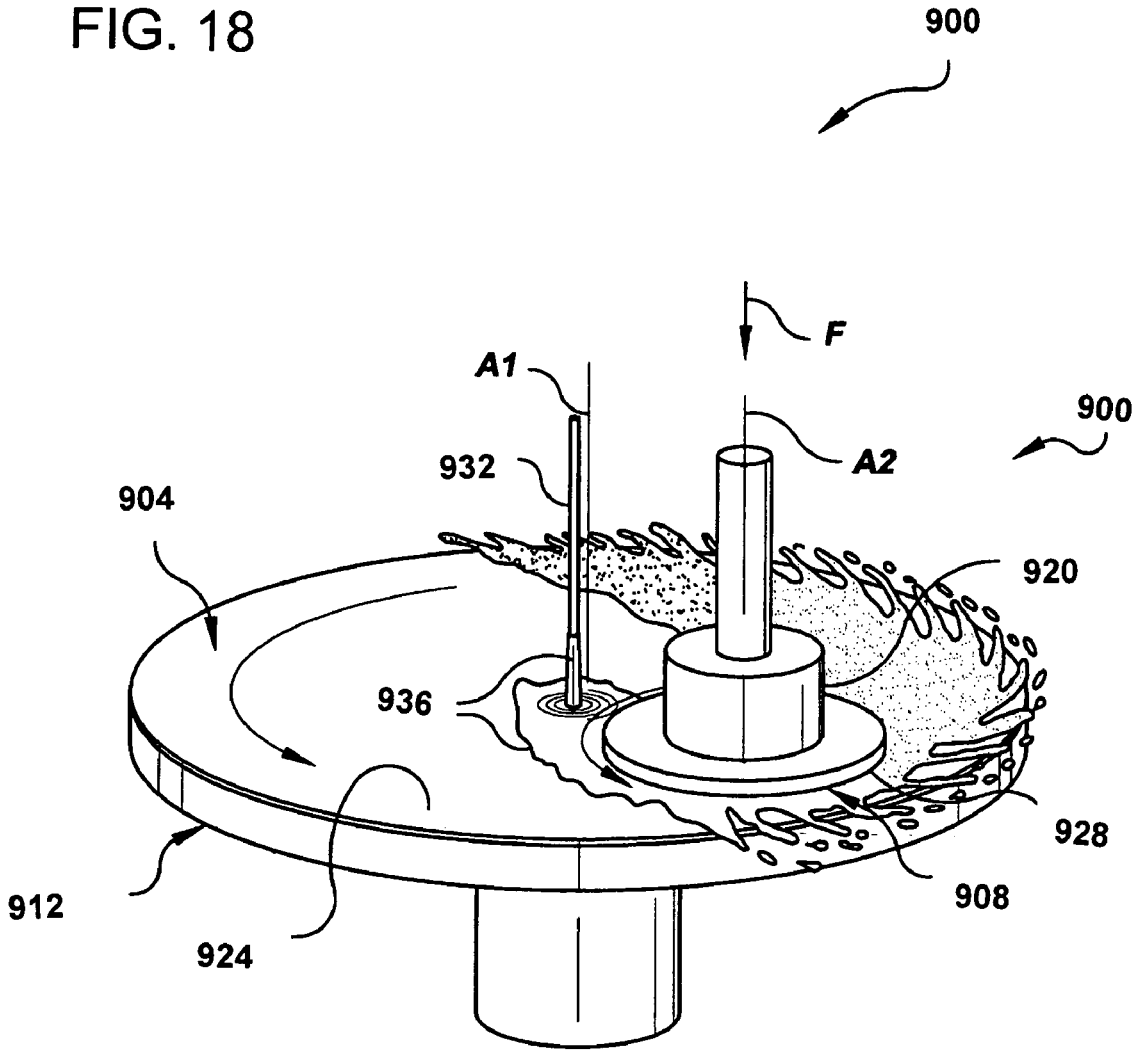
FIG. 18 is a schematic diagram of a polishing system in accordance with the present invention.

FIG. 18 illustrates a polisher 900 suitable for use with a polishing pad 904, which may be one of polishing pads 100, 200, 300, 400, 500, 600, 700, 800 of FIGS. 1-13 or other polishing pads of the present disclosure, for polishing an article, such as a wafer 908. Polisher 900 may include a platen 912 on which polishing pad 904 is mounted. Platen 912 is rotatable about a rotational axis A1 by a platen driver (not shown). Polisher 900 may further include a wafer carrier 920 that is rotatable about a rotational axis A2 parallel to, and spaced from, rotational axis A1 of platen 912 and supports wafer 908 during polishing. Wafer carrier 920 may feature a gimbaled linkage (not shown) that allows wafer 908 to assume an aspect very slightly non-parallel to the polishing surface 924 of polishing pad 904, in which case rotational axes A1, A2 may be very slightly askew relative to each other. Wafer 908 includes a polished surface 928 that faces polishing surface 924 and is planarized during polishing. Wafer carrier 920 may be supported by a carrier support assembly (not shown) adapted to rotate wafer 908 and provide a downward force F to press polished surface 924 against polishing pad 904 so that a desired pressure exists between the polished surface and the pad during polishing. Polisher 900 may also include a polishing medium inlet 932 for supplying a polishing medium 936 to polishing surface 924.

As those skilled in the art will appreciate, polisher 900 may include other components (not shown) such as a system controller, polishing medium storage and dispensing system, heating system, rinsing system and various controls for controlling various aspects of the polishing process, such as: (1) speed controllers and selectors for one or both of the rotational rates of wafer 908 and polishing pad 904; (2) controllers and selectors for varying the rate and location of delivery of polishing medium 936 to the pad; (3) controllers and selectors for controlling the magnitude of force F applied between the wafer and polishing pad, and (4) controllers, actuators and selectors for controlling the location of rotational axis A2 of the wafer relative to rotational axis A1 of the pad, among others. Those skilled in the art will understand how these components are constructed and implemented such that a detailed explanation of them is not necessary for those skilled in the art to understand and practice the present invention.

During polishing, polishing pad 904 and wafer 908 are rotated about their respective rotational axes A1, A2 and polishing medium 936 is dispensed from polishing medium inlet 932 onto the rotating polishing pad. Polishing medium 936 spreads out over polishing surface 924, including the gap between wafer 908 and polishing pad 904. Polishing pad 904 and wafer 908 are typically, but not necessarily, rotated at selected speeds of 0.1 rpm to 750 rpm. Force F is typically, but not necessarily, of a magnitude selected to induce a desired pressure of 0.1 psi to 15 psi (6.9 to 103 kPa) between wafer 908 and polishing pad 904. The carrier groove-pad groove alignment can result in a substantial increase in substrate removal rate. This increase in removal rate allows an operator to use less slurry to achieve an equivalent removal rate to those achieved with circular grooves that do not periodically align with carrier grooves.

The invention claimed is:

1. A polishing pad for use in conjunction with a carrier ring having at least one carrier groove and a leading edge relative to the polishing pad when the polishing pad and carrier ring are being used for polishing at least one of a magnetic, optical and semiconductor substrate in the presence of a polishing medium, the at least one carrier groove having an orientation relative to the carrier ring, the polishing pad having a radius extending from a center of the polishing pad and the radius having a length, the polishing pad comprising:

a) a polishing layer configured for polishing at least one of a magnetic, optical and semiconductor substrate in the presence of a polishing medium, the polishing layer including a circular polishing surface having an annular polishing track during polishing; and b) at least one pad groove having a carrier-compatible groove shape with a continuous groove trajectory within the polishing track with at least a portion of the carrier-compatible groove shape being curved radial and the carrier-compatible groove shape being tangent to a radius of the polishing pad in at least one location along the length of the radius, the carrier-compatible groove shape with a continuous groove trajectory determined as a function of the orientation of the at least one carrier groove so that the at least one carrier groove aligns with the at least one pad groove at a multitude of locations along the carrier-compatible groove shape when the at least one carrier groove is on the leading edge of the carrier ring during polishing.

2. The polishing pad according to claim 1, wherein the carrier-compatible groove shape corresponds to a curve defined by $$\phi(r) = \int_0^{R_{Pad}} \frac{u + \sqrt{1-u^2} + \left(\frac{2RR_c}{r^2+R^2-R_c^2}\right)\sqrt{1-u^2}\left(u - \sqrt{1-u^2}\right)}{u - \sqrt{1-u^2} - \left(\frac{2RR_c}{r^2+R^2-R_c^2}\right)\sqrt{1-u^2}\left(u + \sqrt{1-u^2}\right)} \frac{dr}{r}$$

$$\text{where } u = \frac{R^2 + R_c^2 - r^2}{2RR_c}$$

wherein R is the radial distance from a concentric center of the polishing pad to the center of the carrier ring, $R_c$ is the radius of the carrier ring, $R_{Pad}$ is the radius of the polishing pad, and r is the radial distance from a concentric center of the polishing pad to a point on the carrier-compatible groove shape.

3. The polishing pad according to claim 1, wherein the carrier-compatible groove shape corresponds to a curve defined by $$\phi(r) = \int_0^{R_{Pad}} \frac{(r-R) - R_c\sqrt{1-\left(\frac{r-R}{R_c}\right)^2}}{(r-R) + R_c\sqrt{1-\left(\frac{r-R}{R_c}\right)^2}} \frac{dr}{r}$$

wherein R is the radial distance from a concentric center of the polishing pad to the center of the carrier ring, $R_c$ is the radius of the carrier ring, $R_{Pad}$ is the radius of the polishing pad, and r is the radial distance from a concentric center of the polishing pad to a point on the carrier-compatible groove shape.

4. The polishing pad according to claim 1, wherein the carrier-compatible groove shape traverses at least two-thirds of the polishing track.

5. The polishing pad according to claim 1, wherein the polishing pad has a plurality of pad grooves having a carrier-compatible groove shape, the plurality of pad grooves being dispersed circumferentially around the polishing pad.

6. A polishing pad designed to cooperate with a carrier ring having at least one carrier groove and a leading edge relative to the polishing pad when the polishing pad and carrier ring are being used for polishing at least one of a magnetic, optical and semiconductor substrate in the presence of a polishing medium, the at least one carrier groove having an orientation relative to the carrier ring, the polishing pad having a radius extending from a center of the polishing pad and the radius having a length, the polishing pad comprising:

a) a polishing layer configured for polishing at least one of a magnetic, optical and semiconductor substrate in the presence of a polishing medium, the polishing layer including a circular polishing surface having an annular polishing track during polishing; and b) at least one pad groove set having two or more pad grooves, the two or more pad grooves formed in the polishing layer and each of the two or more pad grooves having a carrier-compatible groove shape with a continuous groove trajectory and with at least a portion of the carrier-compatible groove shape being curved radial and the carrier-compatible groove shape being tangent to a radius of the polishing pad in at least one location along the length of the radius and the carrier-compatible groove shape with a continuous groove trajectory within the polishing track aligning with at least one carrier groove as a function of the orientation of the at least one carrier groove when the at least one carrier groove is located along the leading edge of the carrier ring during polishing.

7. The polishing pad according to claim 6, wherein the carrier-compatible groove shape corresponds to a curve defined by $$\phi(r) = \int_0^{R_{Pad}} \frac{u + \sqrt{1-u^2} + \left(\frac{2RR_c}{r^2+R^2-R_c^2}\right)\sqrt{1-u^2}\left(u - \sqrt{1-u^2}\right)}{u - \sqrt{1-u^2} - \left(\frac{2RR_c}{r^2+R^2-R_c^2}\right)\sqrt{1-u^2}\left(u + \sqrt{1-u^2}\right)} \frac{dr}{r}$$

$$\text{where } u = \frac{R^2 + R_c^2 - r^2}{2RR_c}$$

wherein R is the radial distance from a concentric center of the polishing pad to the center of the carrier ring, $R_c$ is the radius of the carrier ring, $R_{Pad}$ is the radius of the polishing pad, and r is the radial distance from a concentric center of the polishing pad to a point on the carrier-compatible groove shape.

8. The polishing pad according to claim 6, wherein the carrier-compatible groove shape corresponds to a curve defined by $$\phi(r) = \int_0^{R_{Pad}} \frac{(r-R) - R_c\sqrt{1-\left(\frac{r-R}{R_c}\right)^2}}{(r-R) + R_c\sqrt{1-\left(\frac{r-R}{R_c}\right)^2}} \frac{dr}{r}$$

wherein R is the radial distance from a concentric center of the polishing pad to the center of the carrier ring, $R_c$ is the radius of the carrier ring, $R_{Pad}$ is the radius of the polishing pad, and r is the radial distance from a concentric center of the polishing pad to a point on the carrier-compatible groove shape.

9. The polishing pad according to claim 6, wherein the carrier-compatible groove shape traverses at least two-thirds of the polishing track.

10. A method of making a rotational polishing pad for use with a carrier ring having at least one carrier groove and a leading edge relative to the polishing pad when the polishing pad and carrier ring are being used for polishing at least one of a magnetic, optical and semiconductor substrate in the presence of a polishing medium, the at least one carrier groove having an orientation relative to the carrier ring, the polishing pad having a radius extending from a center of the polishing pad and the radius having a length, the method comprising:

a) determining a carrier-compatible groove shape with a continuous groove trajectory in substantial alignment with at least one carrier groove as a function of the orientation of the at least one carrier groove when the at least one carrier groove is located along the leading edge of the carrier ring during polishing; and b) forming in the rotational polishing pad at least one pad groove having the carrier-compatible groove shape with at least a portion of the carrier-compatible groove shape being curved radial and the carrier-compatible groove shape with a continuous groove trajectory being tangent to a radius of the polishing pad in at least one location along the length of the radius.

* * * * *